US011551641B2

(12) United States Patent
Niizuma

(10) Patent No.: US 11,551,641 B2
(45) Date of Patent: Jan. 10, 2023

(54) DISPLAY APPARATUS AND DISPLAY METHOD

(71) Applicant: SHARP KABUSHIKI KAISHA, Sakai (JP)

(72) Inventor: Ryosuke Niizuma, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/506,593

(22) Filed: Oct. 20, 2021

(65) Prior Publication Data

US 2022/0130347 A1 Apr. 28, 2022

(30) Foreign Application Priority Data

Oct. 28, 2020 (JP) ..... JP2020-180846
Jul. 20, 2021 (JP) ..... JP2021-119742

(51) Int. Cl.
*G09G 5/10* (2006.01)
*G09G 3/3233* (2016.01)

(52) U.S. Cl.
CPC ..... *G09G 5/10* (2013.01); *G09G 3/3233* (2013.01); *G09G 2320/0233* (2013.01); *G09G 2320/0673* (2013.01)

(58) Field of Classification Search
CPC ..... G09G 5/10; G09G 3/3233; G09G 2320/0233; G09G 2320/0673; G09G 2360/144
See application file for complete search history.

(56) References Cited

U.S. PATENT DOCUMENTS

2002/0130830 A1* 9/2002 Park ..... G09G 3/3406 345/99
2008/0001974 A1 1/2008 Kim et al.
2014/0152721 A1* 6/2014 Byun ..... G09G 3/3208 345/82
2018/0090083 A1* 3/2018 Kim ..... G09G 3/3666
2019/0066628 A1* 2/2019 Wang ..... G09G 5/10
2020/0126500 A1* 4/2020 Hwang ..... G09G 3/3648
2020/0335042 A1* 10/2020 Son ..... G09G 3/3291
2020/0396430 A1* 12/2020 Funada ..... G06T 5/009
2021/0248950 A1* 8/2021 Jin ..... G09G 3/20

FOREIGN PATENT DOCUMENTS

JP 2008-15515 A 1/2008
JP 2010-286783 A 12/2010

* cited by examiner

*Primary Examiner* — Jeff Piziali
(74) *Attorney, Agent, or Firm* — ScienBiziP, P.C.

(57) ABSTRACT

A display apparatus includes a luminance controller that controls a luminance of a displayed video, a gamma controller that applies a gamma curve to a video signal, and a display that displays a video represented by the video signal that the gamma controller has applied the gamma curve to. If the luminance controller causes the display to display the video at a luminance value lower than a predetermined luminance value, the gamma controller applies to the video signal a gamma curve with a lower gradation region raised more than a gamma curve represented by a predetermined constant gamma coefficient.

16 Claims, 19 Drawing Sheets

DISPLAY APPARATUS AND DISPLAY METHOD

BACKGROUND

1. Field

The present disclosure relates to a display apparatus and a display method.

2. Description of the Related Art

A variety of display apparatuses and display methods are disclosed. One of the disclosed apparatuses includes a display controller device and a display. The display controller device includes a target chromaticity setting unit, a fixed-icon chromaticity calculating unit, and as image processor. The target chromaticity setting unit sets a target chromaticity that allows characteristic degradation of each color to be equalized on the display. The fixed-icon chromaticity calculating unit calculates the chromaticity of a fixed icon on a display screen of the display. The image processor corrects an input image signal such that the chromaticity of the fixed icon approximates to a target chromaticity. Along with an operation of reducing a luminance value, the display apparatus performs corrections such that the chromaticity of the fixed-icon linearly approximates to the target chromaticity. (Reference is made to Japanese Unexamined Patent Application Publication No. 2010-286783.)

According to the disclosed. technique, the operation of reducing the luminance value is performed but gradation. in a lower gradation region may be difficult to recognize when a darker image is displayed.

It is desirable that gradation of a darker image is a lower gradation region is easily recognizable even when as operation of reducing a luminance value is performed.

SUMMARY

According to an aspect of the disclosure, there is provided a display apparatus including: a display controller including a luminance controller that controls a luminance of a displayed video; and a gamma controller that adjusts a gain of a video signal and a display that displays a video represented by a video signal that has been adjusted by the gamma controller, wherein if the luminance controller causes the display to display the video at a luminance value lower than a predetermined luminance value, the display controller: compares a first luminance and a second luminance respectively in a first gradation and in a second gradation of the video that is brighter than the first gradation with a third luminance and a fourth luminance respectively in the first gradation and the second gradation of the video when the luminance controller causes the display to display the video at the predetermined luminance value; and controls luminance of the display such that a second amount of change with the fourth luminance serving as a denominator and the second luminance serving as a numerator is lower than a first amount of change with the third luminance serving as a denominator and the first luminance serving as a numerator.

According to another aspect of the disclosure, there is provided a display apparatus including: a luminance controller that controls a luminance of a displayed video; a gamma controller that applies a gamma curve to a video signal; and a display that displays a video represented by the video signal that the gamma controller has applied the gamma curve to, wherein if the luminance controller causes the display to display the video at a luminance value lower than a predetermined luminance value, the gamma controller applies to the video signal a gamma curve having a lower gradation region raised more than a gamma curve represented by a predetermined constant gamma coefficient.

According to another aspect of the disclosure, there is provided a display apparatus including: a luminance controller that controls a luminance of a dis laved video; a gamma controller that applies a gamma curve to a video signal; and a display that displays a video represented by the video signal that the gamma controller has applied the gamma curve to, wherein if the luminance controller causes the display to display the video at a luminance value lower than a predetermined luminance value, the gamma controller applies to the video a gamma curve having a gamma coefficient lower than a gamma coefficient of the gamma curve that is applied to display the video at the predetermined luminance value or higher.

According to a other aspect of the disclosure, there is provided a display method of a display apparatus including: controlling displaying, including controlling a luminance of a video and adjusting a gain of a video signal; and displaying a video represented by the video signal that has been adjusted in the adjusting of the gain, wherein if the video is displayed in the displaying of the video at a luminance value lower than a predetermined luminance value, a first luminance and a second luminance respectively in a first gradation and a second gradation of the video that is brighter than the first gradation are compared with a third luminance and a fourth luminance respectively in the first gradation and the second gradation of the video with the video displayed at the predetermined luminance value in the displaying of the video; and luminance is controlled such that a second amount of change with the fourth luminance serving as a denominator and the second luminance serving as a numerator is lower than a first amount of change with the third luminance serving as a denominator and the first luminance serving as a numerator.

According to another aspect of the disclosure, there is provided a display method of a display apparatus including: controlling a luminance of a displayed video; applying a gamma curve to a video signal; and displaying a video represented by the video signal that the gamma curve has been applied to in the applying of the gamma curve, wherein if the video is displayed in the displaying of the video at a luminance value that is lower than a predetermined luminance value in the controlling of the luminance, a gamma curve having a lower gradation region raised more than a gamma curve represented by a constant gamma coefficient is applied to the video signal in the applying of the gamma curve.

According to another aspect of the disclosure, there is provided a display method of a display apparatus including: controlling a luminance of a displayed video; applying a gamma curve to a video signal; and displaying a video represented by the video signal that the gamma curve has been applied to in the applying of the gamma curve, wherein if the video is displayed in the displaying of the video at a luminance value that is lower than a predetermined luminance value in the controlling of the luminance, a gamma curve having a gamma coefficient lower than a gamma coefficient of the gamma curve that is applied to display the video at the predetermined luminance value or higher is applied to the video signal in the applying of the gamma curve.

BRIEF DESCRIPTION OF THE DRAWINGS

in FIG. 7;

DESCRIPTION OF THE EMBODIMENTS

Reference Technique and Preliminary Configuration

Before describing embodiments of the disclosure, related art techniques and preliminary configuration thereof are described below as a supplementary to the background technique described above.

To control the screen burning of a display apparatus, a luminance controller reduces a display luminance of a display in response to a video, humidity, operation time, and the like. When the display luminance is reduced, a luminance difference between gradation values in a lower gradation region may become smaller depending on the amount of reduction and a darker portion of the video may look blurred.

Figure 21:
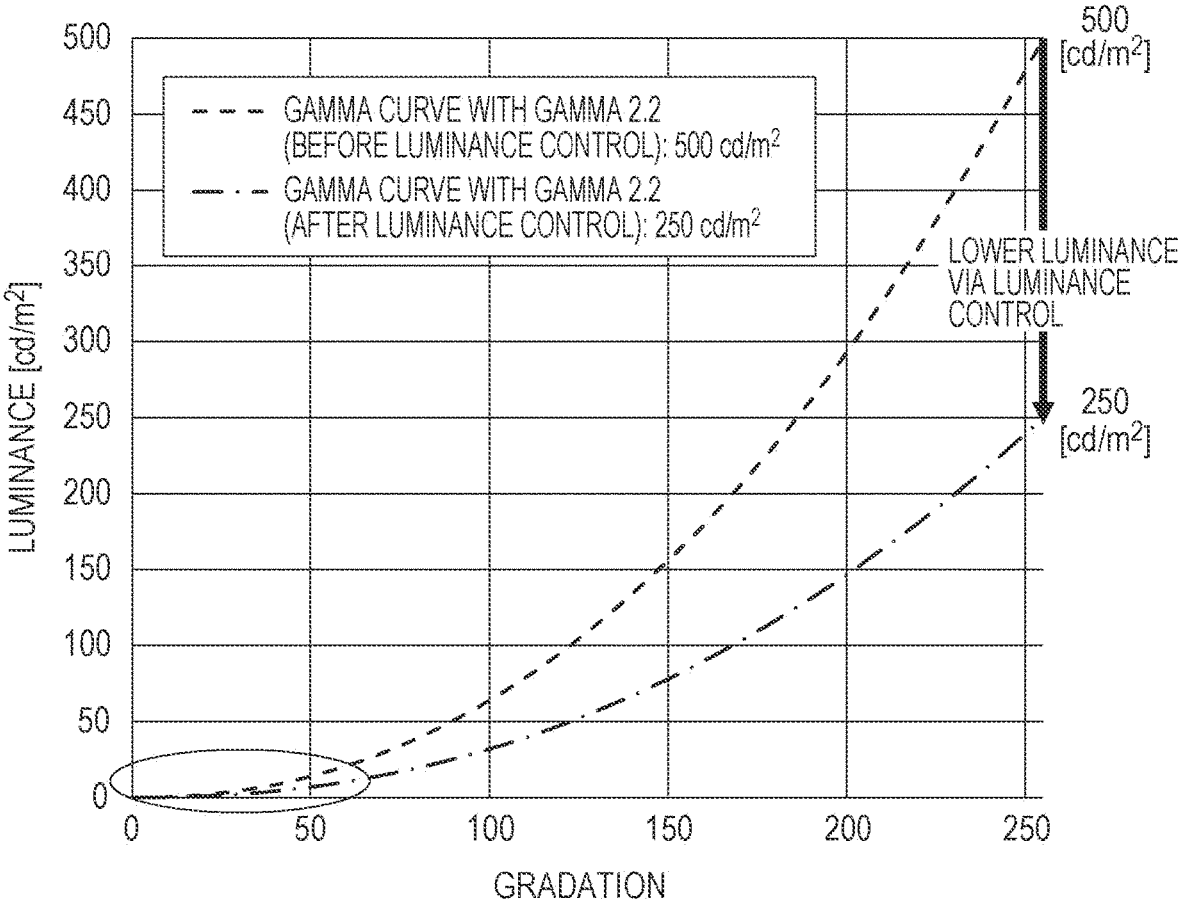
FIG. 21 illustrates a problem occurring in a lower gradation region when luminance is lowered in a display apparatus of related art.

FIG. 21 illustrates a problem that occurs in the lower gradation region when the luminance is reduced on a related-art display apparatus. Referring to FIG. 21, if the luminance controller reduces the display luminance from 500 cd/m$^2$ to 250 cd/m$^2$, the luminance of the lower gradation region (a portion enclosed by an ellipse) also decreases. The luminance difference of the gradation becomes smaller, causing the gradation of the darker portion of a displayed video to look blurred.

Techniques that may address the above-described problem are described with reference to embodiments of the disclosure.

First Embodiment

First embodiment of the disclosure is described with reference to FIGS. 1 through 4.

Figure 1:
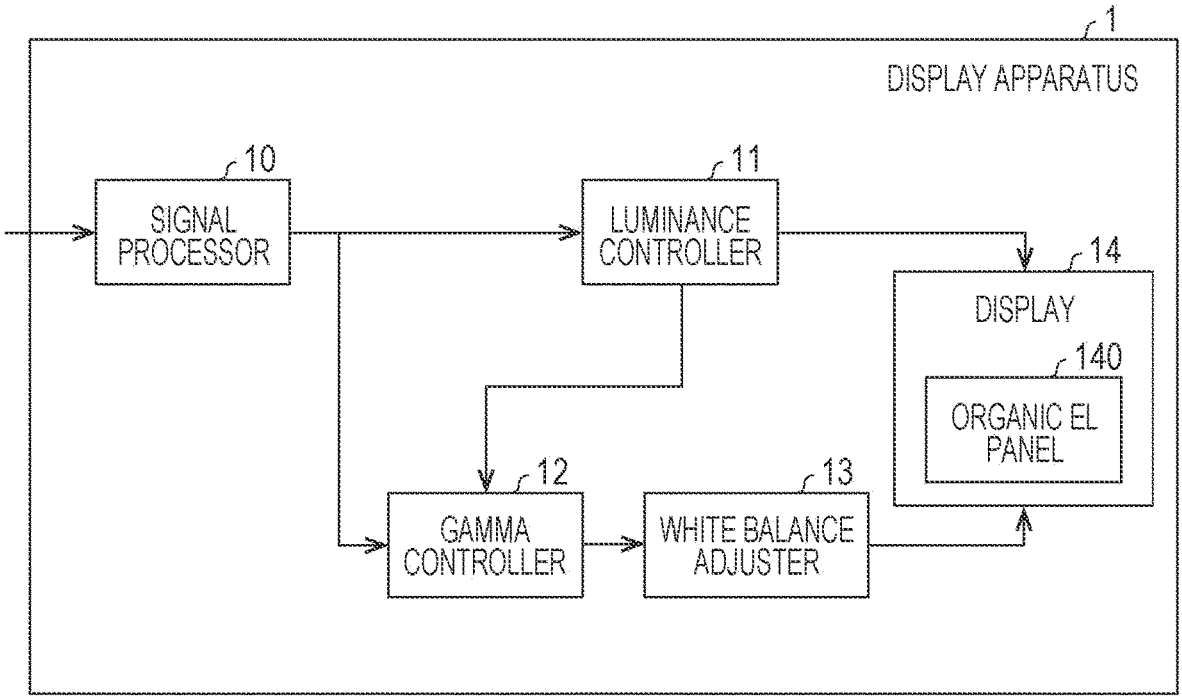
FIG. 1 is a block diagram illustrating a configuration of a display apparatus of a first embodiment of the disclosure.

FIG. 1 is a block diagram illustrating a configuration of a display apparatus 1. In the first embodiment, the display apparatus 1 is an organic electroluminescent (EL) apparatus including organic light-emitting diodes (OLEDs). Since an organic EL apparatus more likely suffers from burning than a liquid-crystal apparatus, frequency and degree of reducing luminance to control burning are more demanding. The techniques disclosed herein may be more effective to control burning.

Referring to FIG. 1, the display apparatus 1 includes a signal processor 10, luminance controller 11, gamma controller 12, white balance adjuster 13, and display 14.

The signal processor 10 separates, from a video and audio signal input from the outside, a video signal, audio signal, and signal on character information and outputs the video signal to the luminance controller 11 and gamma controller 12.

In response to at least the video signal input from the signal processor 10 or a luminance control instruction input to the luminance controller 11, the luminance controller 11 controls the luminance of the video displayed on the display 14. In an exemplary method of controlling the luminance, the luminance controller 11 may control the luminance of the displayed video by adjusting the magnitude of a current supplied to the display 14.

To control the luminance of the video displayed on the display 14, the luminance controller 11 supplies the gamma controller 12 with information concerning the luminance of the video displayed on the display 14.

The gamma controller 12 references the information concerning the luminance of the displayed video input from the luminance controller 11 and performs gamma control by adjusting a gain for each of RGB (red, green, and blue) signals of the video signal supplied from the signal processor 10. The gamma controller 12 outputs the gamma corrected video signal to the white balance adjuster 13. In the discussion of the embodiments, the luminance controller 11 and gamma controller 12 may also be collectively referred to as a display controller.

The white balance adjuster 13 adjusts white balance on the video signal input from the gamma controller 12 such that the video signal is compatible with an organic EL panel 140 in the display 14. The white balance adjuster 13 outputs the white-balance adjusted video signal to the display 14.

The display 14 causes the organic EL panel 140 to display a video in response to the control signal output from the luminance controller 11 and the video signal output from the white balance adjuster 13.

The gamma controller 12 of the first embodiment is describe in greater detail below. The gamma controller 12 applies a gamma curve to the input video signal. In an application example, when the luminance controller 11 causes the display 14 to display the video at a luminance value lower than a predetermined luminance value, the gamma controller 12 applies to the video signal a gamma curve with lower gradation region raised more than a gamma curve represented by a predetermined constant gamma coefficient.

Figure 2:
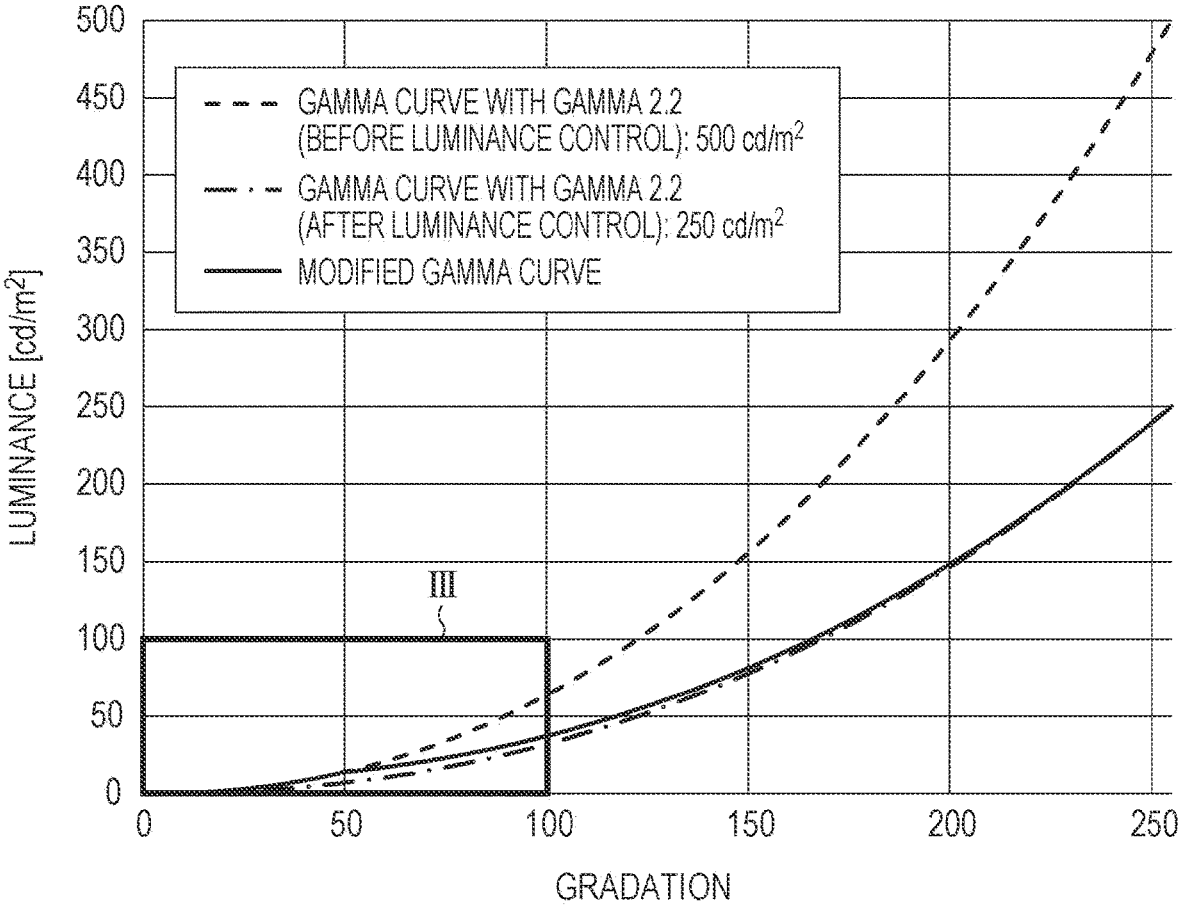
FIG. 2 is a graph illustrating results of control performed by a gamma controller illustrated in FIG. 1.
Figure 3:
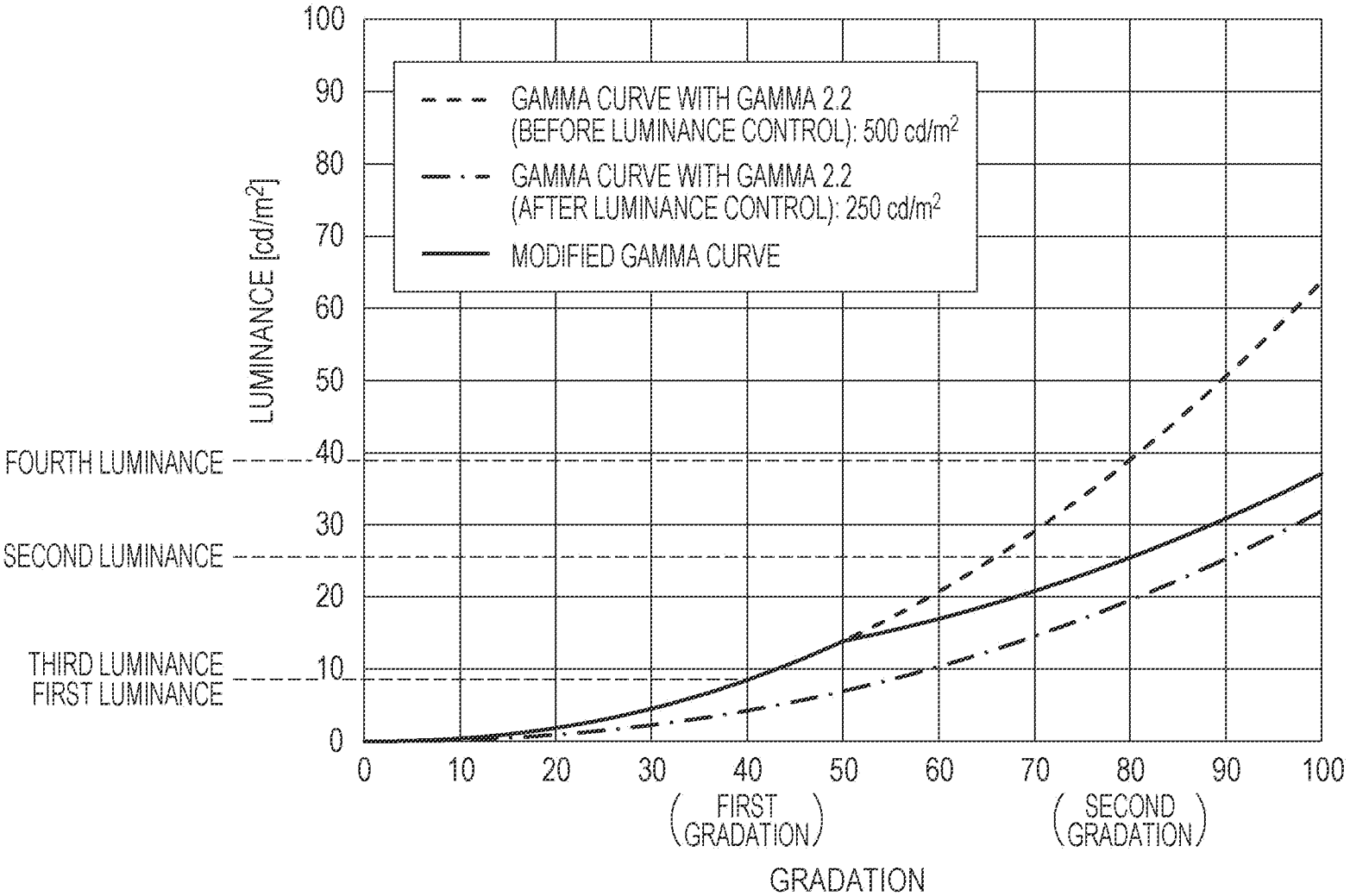
FIG. 3 is an expanded view of the portion III of FIG. 2.

FIG. 2 is a graph illustrating results of control performed by the gamma controller 12 illustrated in FIG. 1, FIG. 3 is an expanded view of the portion III of FIG. 2. Referring to FIGS. 2 and 3, if the luminance controller 11 reduces luminance from a predetermined luminance value of 500 cd/m$^2$ to a lower luminance value of 250 cd/m$^2$, the gamma controller 12 applies to the video signal a gamma curve with a lower gradation region raised more than a gamma curve represented by a predetermined constant gamma coefficient, for example, a gamma of 2.2.

Referring to FIGS. 2 and 3, a broken-line curve represents a gamma curve before luminance control, a dot-dash-line curve represents a gamma curve after the luminance control, and a solid-line curve represents a gamma curve that is applied to the video signal in accordance with the first embodiment.

In the graphs in FIGS. 2 and 3 according to the first embodiment, the abscissa represents gradation values of the video signal input to the gamma controller 12 and the ordinate represents luminance values of the video represented by the video signal output by the gamma controller 12. The same is true of FIGS. 17 through 19 as described with reference to a seventh embodiment.

In the configuration described above, if the luminance controller 11 causes the display 14 to display a video at a luminance value lower than a predetermined luminance value, the gamma controller 12 applies to the video signal a gamma curve with a lower gradation region raised more than a gamma curve represented by a predetermined constant gamma coefficient. Even when an operation of reducing the luminance value is performed, the gradations in the lower gradation region of a darker 1mage may be more likely recognizable. The operation of reducing the luminance value on the display may be used to reduce the burning of the display apparatus.

The first embodiment is continuously described with reference to FIG. 3. FIG. 3 is an expanded view of the portion III of FIG. 2. Referring to FIG. 3, in a range of a predetermined gradation value or lower, for example, gradation value of 50 or lower on an 8-bit gradation, the gamma curve to be applied by the gamma controller 12 is represented by a constant gamma coefficient, for example, a gamma of 2.2 and overlaps a gamma curve responsive to a given output luminance value, for example, 500 cd/m$^2$. In a range higher than the gradation value, for example, the gradation value of 50 on the 8-bit gradation, the gamma curve to be applied by the gamma controller 12 is represented by a constant gamma coefficient, for example, a gamma of 2.2 and closer to a gamma curve responsive to an output luminance, lower than the given output luminance value, for example, 250 cd./m$^2$.

In this configuration, the gradations of a darker image in the lower gradation region may be more likely recognizable even when the luminance value is reduced.

The luminance value is lowered from 500 cd/m$^2$ to 250 cd/m$^2$ as described above. The first embodiment is not limited to this setting. According to the first embodiment, the luminance value may be lowered from 500 cd/m$^2$ to 400 cd/m$^2$.

As described above, the predetermination gradation value is 50 with the 8-bit gradation. The first embodiment is not limited to this setting. The predetermined gradation value may be within a range of 5% or higher to 25% or lower than a maximum design value of the gradation value. For example, in the case of the 8-bit gradation, the predetermined gradation value may fall within a range of gradation value of 13 or higher to a gradation value of 63 or lower.

In the configuration described above, the predetermined gradation value may be set to any value as appropriate.

FIG. 3 illustrates first through fourth luminance (values), and first and second gradation (values). According to the first embodiment, when the luminance controller 11 causes the display 14 to display the video at a luminance value lower than a predetermined luminance value, the luminance controller 11 controls the luminance of the display 14 as described below.

The luminance controller 11 compares the first and second luminance values and the third and fourth luminance values. The luminance controller 11 calculates a first amount of change with the third luminance value serving as a denominator and the first luminance value serving as a numerator. The luminance controller 11 further calculates a second amount of change with the fourth luminance value serving as a denominator and the second luminance value serving as a numerator. Finally, the luminance controller 11 controls the luminance of the display 14 such that the second amount of changes is smaller than the first amount of change.

The first luminance value is luminance of the video in the first gradation on the display 14 and the second luminance value is luminance of the video brighter than the first luminance value on the display 14.

The third luminance value is luminance on the display 14 in the first gradation when the luminance controller 11 causes the display 14 to display the video at the predetermined luminance value (before the luminance control), and the fourth luminance value is luminance on the display 14 in the second gradation when the luminance controller 11 causes the display 14 to display the video at the predetermined luminance value on (before the luminance control).

For example, referring to FIG. 3, the first and third luminance values are about 8 cd/m$^2$, the second luminance value is about 25 cd/m$^2$, and the fourth luminance value is 38 cd/m$^2$. The first amount of change is 1 (100%) and the second amount of change is about 0.66 (66%). In this way, the second amount of change is smaller than the first amount of change.

Figure 4:
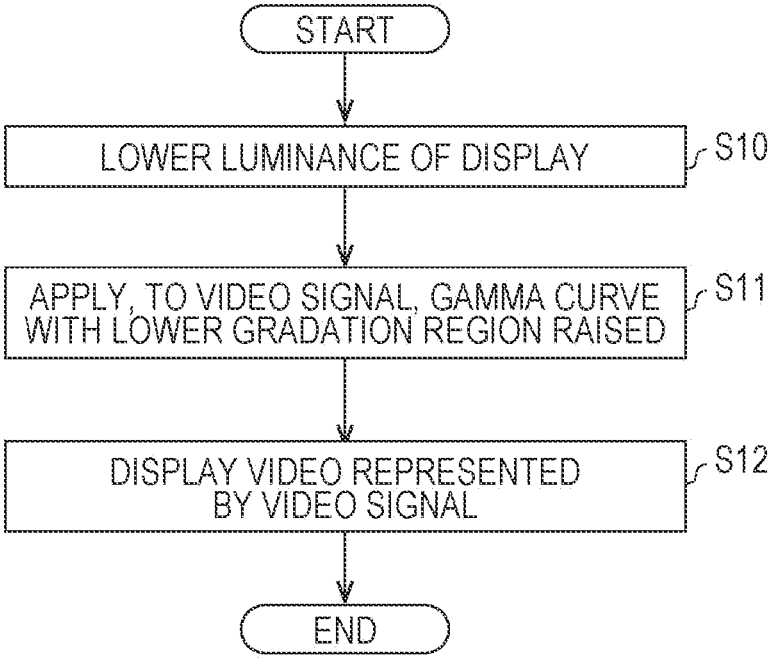
FIG. 4 is a flowchart illustrating a display method of the display apparatus illustrated in FIG. 1.

A display method of the first embodiment is described with reference to FIG. 4. FIG. 4 is a flowchart illustrating the display method of the display apparatus 1 illustrated in FIF. 1. Referring to FIG. 4, a luminance control operation in step S10 performs control such that a luminance value of a video displayed on the display is reduced.

If the luminance control operation is performed to lower the luminance value, a gamma control operation is performed in step S11 so as to apply to the video signal a gamma curve with a lower gradation region raised more than a gamma curve represented by a predetermined, constant gamma coefficient.

In step S12, a display operation displays a video represented by the video signal to which the gamma curve has been applied in the gamma control operation.

Figure 5:
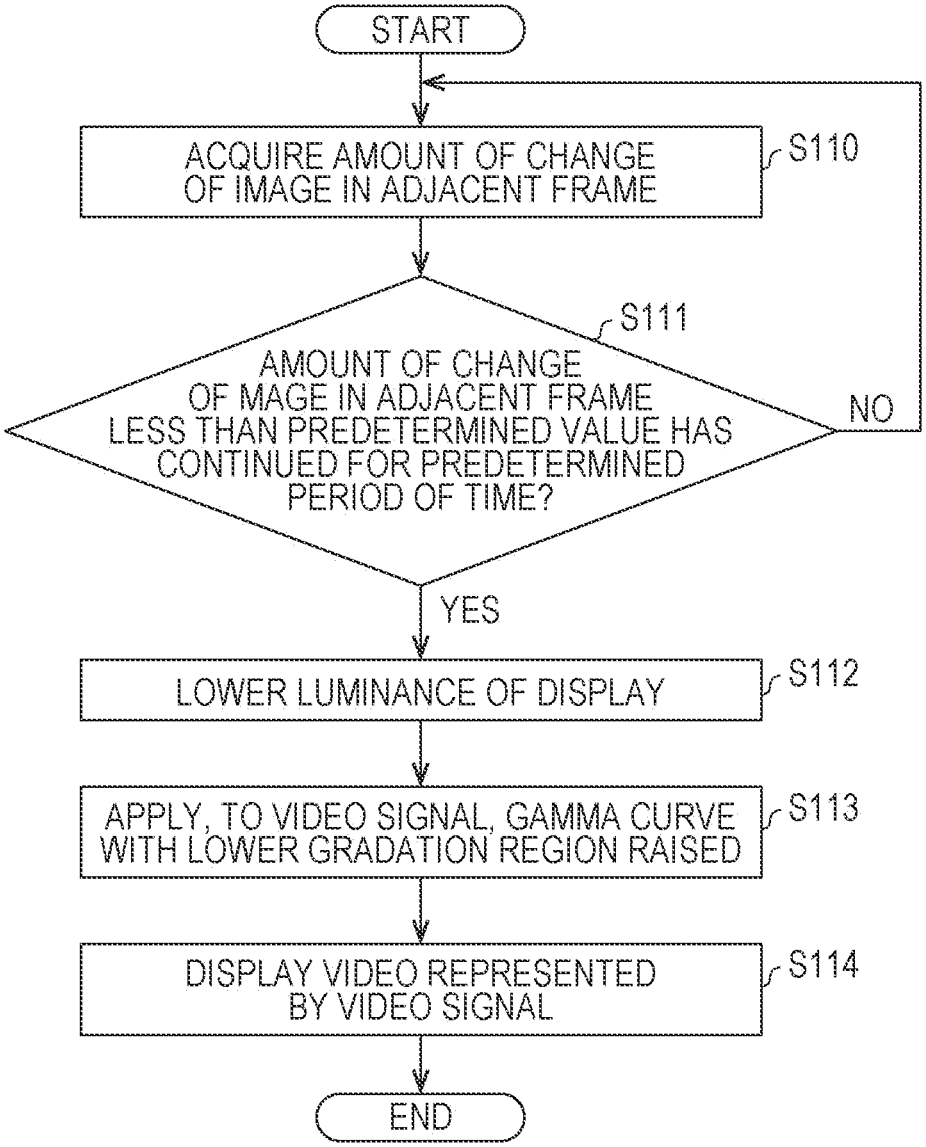
FIG. 5 is a flowchart illustrating an exemplary display method performed by the display apparatus illustrated in FIG. 1.

The display method is further described with reference to FIG. 5. FIG. 5 is a flowchart illustrating an exemplary display method of the display apparatus 1 in FIG. 1.

Referring to FIG. 5, in step S110, the display controller acquires an amount of change of an image in an adjacent frame. In step S111, the display controller determines whether the state of the amount of change in the adjacent frame less than a predetermined value has continued for a predetermined period of time.

If the display controller determines that the state of the amount of change in the adjacent frame less than the predetermined value has continued for the predetermined period of time (yes path in step S111), processing proceeds to step S112. On the other hand, if the display controller determines that the state of the amount of change in the adjacent frame less than the predetermined value has not continued for the predetermined period of time (no path in step S111), processing returns to step S110.

Since operations in steps S112 through S114 are respectively identical to the operations in steps S10 through S12 in FIG. 4, the discussion thereof is not repeated.

According to the first embodiment, the following equations may be used to acquire a gamma curve with a lower gradation region raised by the gamma controller 12.

Gradation value of 50 may now be specified as the predetermined gradation value in the 8-bit gradation. Toward the gradation value of 50 in the 8-bit gradation, equation calculating an gamma output with maximum luminance of 500 cd/m$^2$ before luminance control toward the specified gradation value (each of gradation values of 0 to 50 in the 8-bit gradation) is expressed as follows:

$$(\text{MAX(maximum) luminance}\,(500\ \text{cd/m}^2) - \text{MIN(minimum) luminance}\,(0\ \text{cd/m}^2)) \times (\text{graduation value}/255)\text{^}2.2 + \text{MIN luminance}\,(0\ \text{cd/m}^2) \quad \text{Equation (1)}$$

Equation calculating the gamma output with MAX luminance of 250 cd/m$^2$ after the luminance control toward the specified gradation value (each of gradation values of 0 to 50in the 8-bit gradation) is expressed as follows:

$$(\text{MAX luminance}\,(250\ \text{cd/m}^2) - \text{MIN luminance}\,(0\ \text{cd/m}^2)) \times (\text{graduation value}/255)\text{^}2.2 + \text{MIN luminance}\,(0\ \text{cd/m}^2) \quad \text{Equation (2)}$$

In a range beyond the specified gradation value (namely, each of gradation values 51 to 255 in the 8-bit gradation), equation calculating the gamma output after modification is expressed as follows:

$$(\text{Luminance at the gradation value of 50 represented by 8 bits before the luminance control and determined in accordance with equation (1)}) - (\text{Luminance at the gradation value of 50 represented by 8 bits before the luminance control and determined in accordance with equation (1)} - \text{Luminance at the gradation value of 50 represented by 8 bits after the luminance control and determined in accordance with equation (2)}) \times (1 - (\text{gradation value} - 50)/(255 - 50)) \quad \text{Equation (3)}$$

A gamma curve expressed by a combination of Equations () through (3) is a gamma curve obtained through a gamma contra operation by the gamma controller 12. When luminance is lowered in the luminance control, the use of the gamma curve obtained through the gamma control operation may address the problem that a gradation difference is the lower gradation region in a lower luminance condition becomes smaller and a darker portion of the video becomes blurred and thus invisible.

The calculation described above is an example of modifications of gamma. As another example of gamma modification, to set up a smoother gamma curve, the gamma controller 12 sets up mu e points including a point including the specified gradation and serving as a changing point, a point on Equation (1), a point beyond the specified gradation, and a point on Equation (2), and generates a gamma curve using Lagrange interpolation.

According to the first embodiment, the display controller may modify the manner of raising the gamma curve in response to a display mode, in response to luminance of the display apparatus 1, or in response to average picture level (APL). The same is true of other embodiments.

Second Embodiment

Second embodiment is described below. For convenience of explanation, elements identical to the elements described with reference to the embodiments described above are designated with the same reference numerals and the discussion thereof is not repeated.

Figure 6:
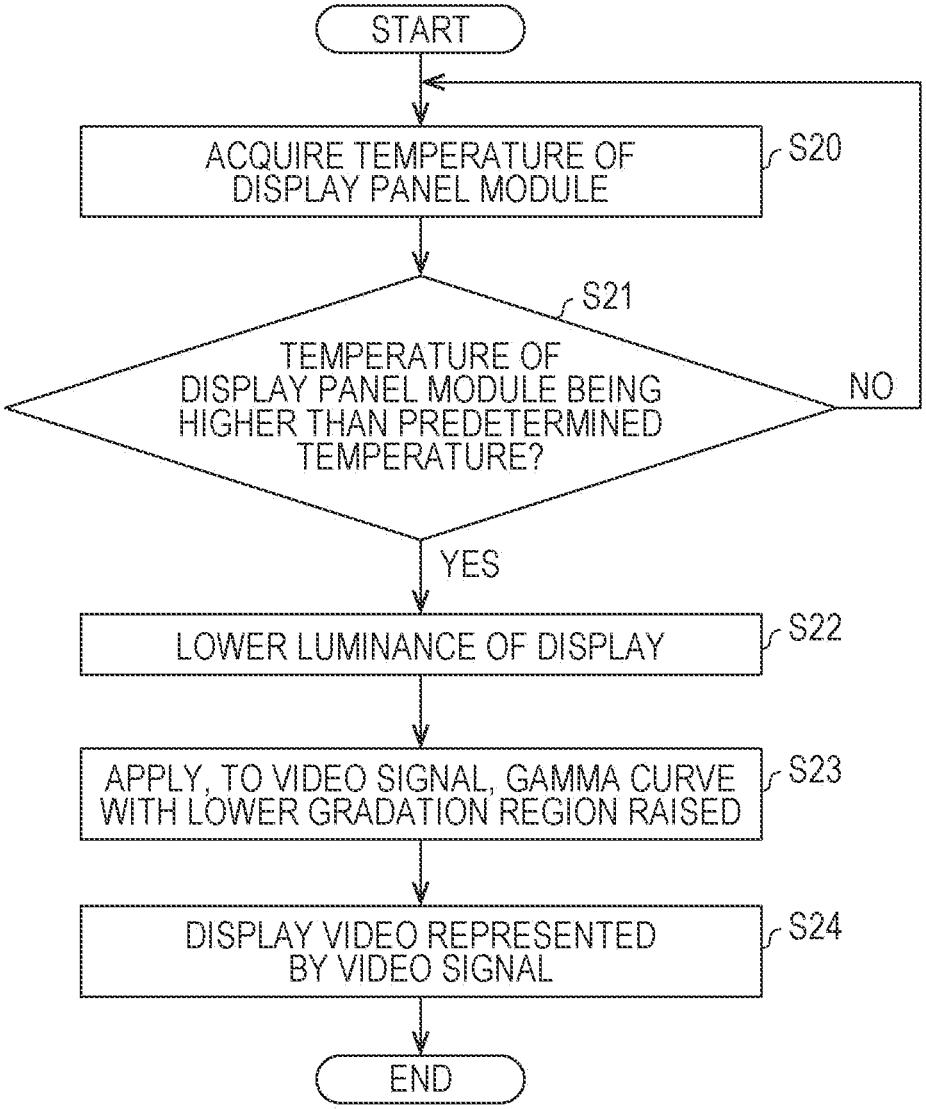
FIG. 6 is a flowchart illustrating a display method performed by the display apparatus of a second embodiment of the disclosure.

The second embodiment is described with reference to FIG. 6. FIG. 6 is a flowchart illustrating a display method performed by the display apparatus 1 in accordance with the second embodiment.

Referring to FIG. 6, the display controller acquires a temperature of a display panel module in step S20. To acquire the temperature, a sensor (not illustrated) may be used. In step S21, the display controller determines whether the temperature of the display panel module is higher than a predetermined temperature.

If the display controller determines that the temperature of the display panel module is higher than a predetermined temperature (yes path in step S21), processing proceeds to step S22. If the display controller determines that the temperature of the display panel module is not higher than the predetermined temperature (no path in step S21), processing returns to step S20.

Operations in steps S22 through S24 are respectively identical to the operations in steps S10 through S12 in FIG. 4 and thus the discussion thereof is not repeated herein.

According to the second embodiment, the gradation is the lower gradation region of a darker image may be easier to recognize even when luminance is lowered by a temperature control function of the display panel module.

According to the second embodiment, the display panel is described. The display panel may be the organic EL panel 140 or the liquid-crystal panel 140*a* described below. In the description of the disclosure, the organic EL panel and liquid-crystal panel are also collectively referred to as a display panel.

Third Embodiment

Third embodiment of the disclosure is described below. For convenience of explanation, elements identical to the elements described with reference to the embodiments described above are designated with the same reference numerals and the discussion thereof is not repeated herein.

Figure 7:
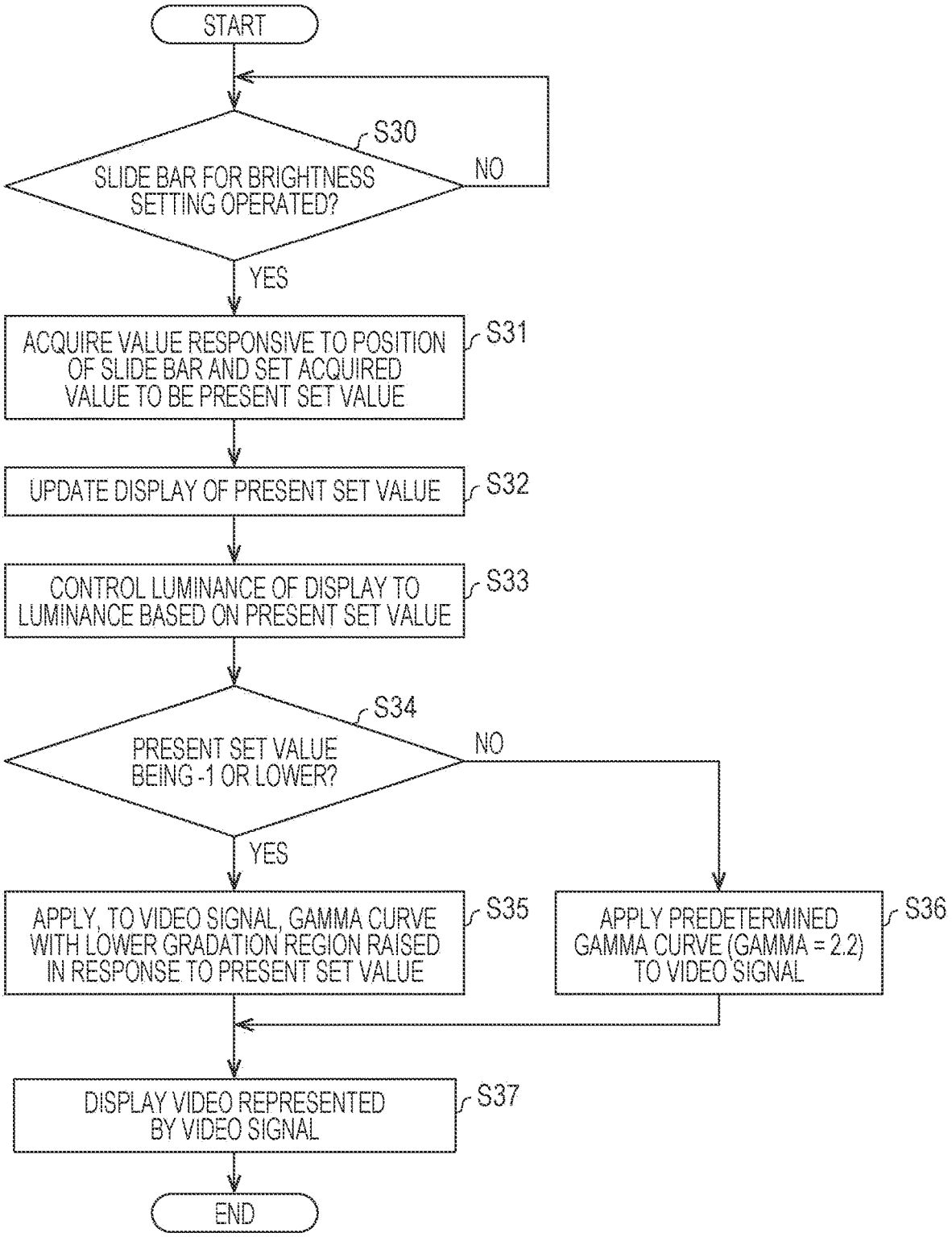
FIG. 7 is a flowchart illustrating a display method performed by the display apparatus of a third embodiment of the disclosure.

The third embodiment is described with reference to FIGS. 7 through 10. FIG. 7 is a flowchart illustrating a display method performed by the display apparatus 1 according to the third embodiment of the disclosure. In the description of the third embodiment, a viewer lowers luminance using a setting item (brightness setting) is a menu.

Referring to FIG. 7, the display controller determines in step S30 whether a brightness setting slide bar has been operated. If the display controller determines that the brightness setting slide bar has been operated (yes path in step S30), processing proceeds to step S31. If the display controller determines that the brightness setting slide bar has not been operated (no path in step S30), the display controller iterates the operation in step S30.

In step S31, the display controller acquires a value corresponding to the position of the slide bar and sets the value to the present set value. In step S32, the display controller updates the displaying of the present set value. In step S33, the luminance controller 11 controls the luminance of the display 14 to a luminance based on the present set value.

In step S34, the display controller determines whether the present set value is −1 or less. If the display controller determines that the present set value is −1 or lower (yes path in step S34), processing proceeds to step S35. On the other hand, if the display controller determines that the present set value is higher than −1 (no path in step S34), processing proceeds to step S36.

In step S35, the gamma controller 12 applies to a video signal a gamma curve with a lower gradation region raised in response to the present set value and processing proceeds to step S37. In step S36, the gamma controller 12 applies a predetermined gamma curve, for example, of a gamma of 2.2 to the video signal, and processing proceeds to step S37. In step S37, the display 14 displays a video represented by the video signal.

Figure 8:
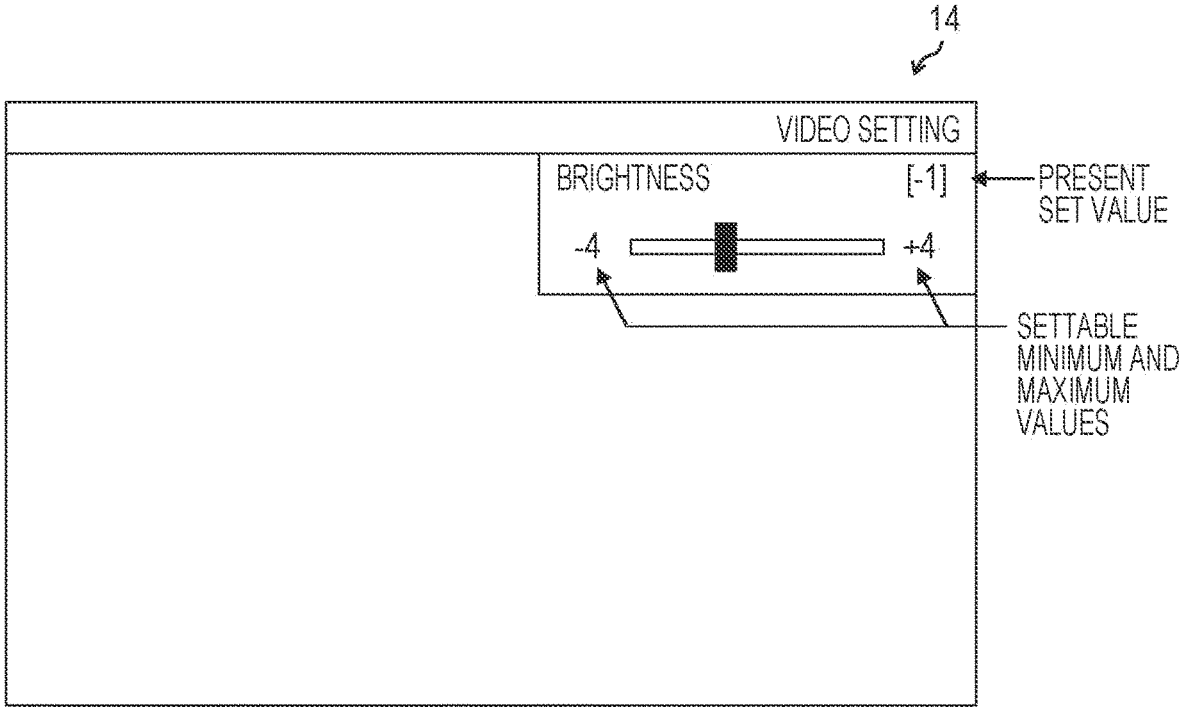
FIG. 8 illustrates a display example of the display apparatus illustrated in FIG. 1.

FIG. 8 illustrates a display example of the display apparatus 1 in FIG. 1. Referring to FIG. 8, the display 14 displays a "video setting" item on a display screen of the display 14. For example, a brightness range that a viewer may operate using the slide bar is −4 to +4 and an integer value within the range is settable. Referring to FIG. 8, the present set value is −1.

Figure 9:
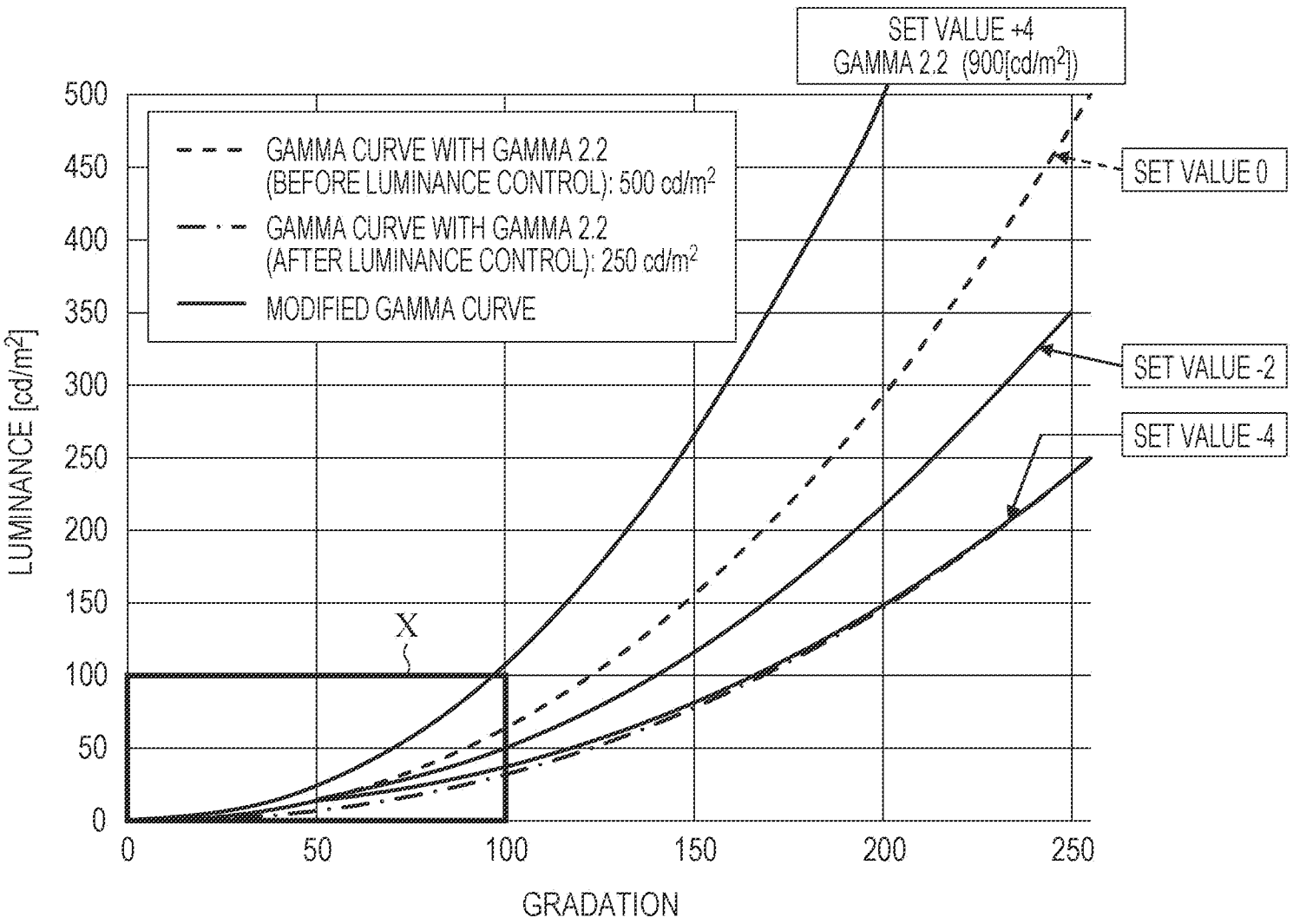
FIG. 9 is a graph illustrating results of control of the display method. illustrated.
Figure 10:
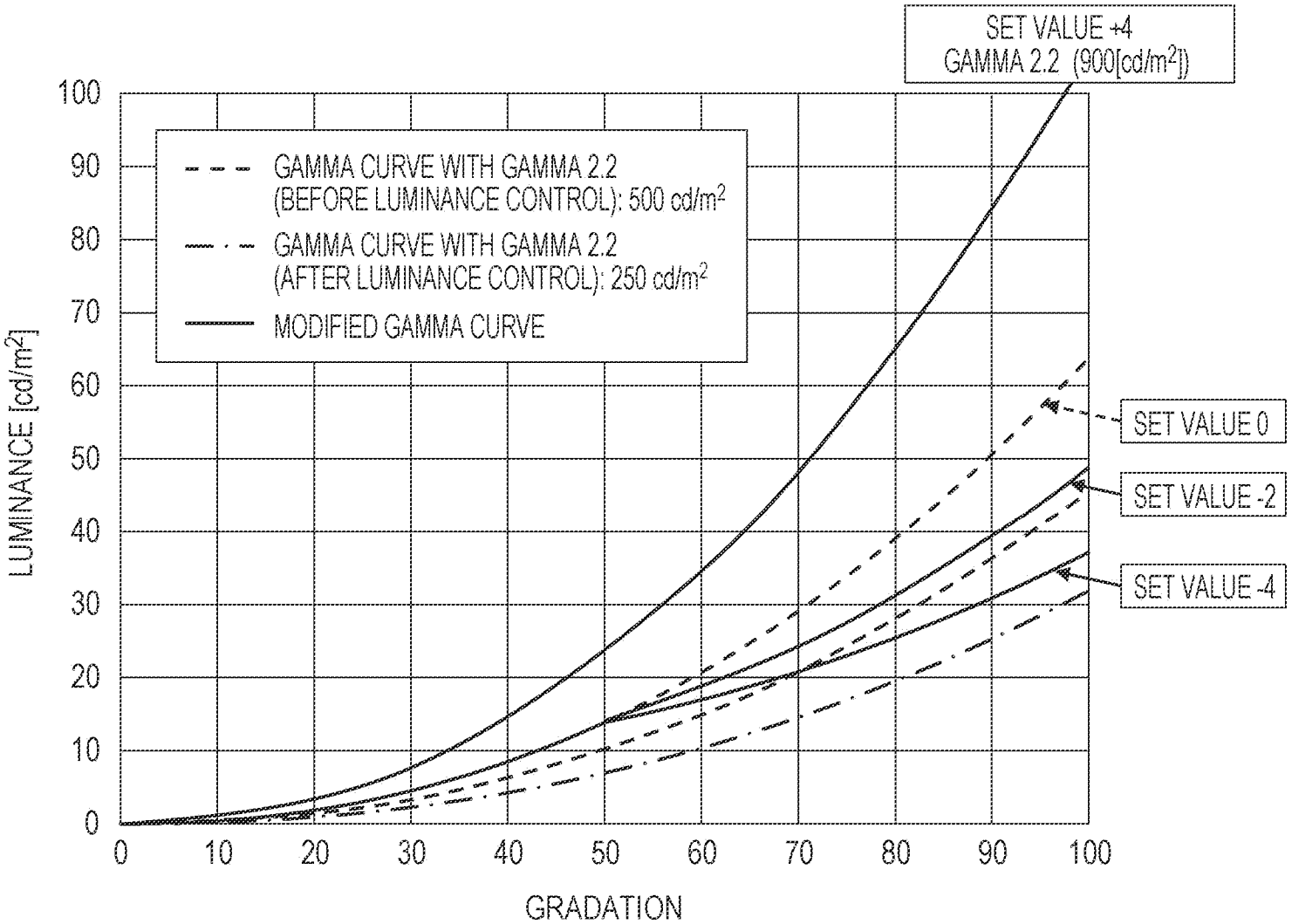
FIG. 10 is as expanded view of the portion X of FIG. 9.

The third embodiment is further described with reference to FIGS. 9 and 10. FIG. 9 is a graph illustrating results of control of the display method illustrated in FIG. 7. FIG. 10 is an expanded view of the portion X of FIG. 9. FIGS. 9 and 10 illustrate gamma curves with the set values being −4, −2, 0, and +4. The gamma curve with the set value of +4 is represented by a gamma of 2.2 and corresponds to an output luminance of 900 cd/m$^2$.

The gamma curve with the set value of 0 is represented. by a gamma of 2.2. and corresponds to an output luminance of 500 cd/m$^2$.

On the other hand, referring to FIG. 10, the gamma controller 12 generates a modified gamma curve (with a lower gradation region raised) with the set value −2. Namely, the gamma controller 12 generates the gamma curve by causing, in a range equal to or higher than the gradation value of 50, the gamma curve to be closer to an unmodified gamma curve with the set value of −2 (lower one of the two broken-line curves in FIG. 10) and causes, in a range equal to or lower than the gradation value of 50, the gamma curve to overlap a gamma curve with set value 0. The gamma controller 12 then applies the generated gamma curve to the video signal.

Referring to FIG. 10, the gamma controller 12 generates a modified gamma curve (with a lower gradation region. raised) with the set value of −4. Namely, the gamma controller 12 generates the gamma curve by causing, in a range equal to or higher than the gradation value of 50, the gamma curve to be closer to an unmodified gamma curve with the set value of −4 (dot-dash-line curve in FIG. 10) and causes, i. a range equal to or lower than the gradation value of 50, the gamma curve to overlap a gamma curve with the set value of 0. The gamma controller 12 then applies the generated gamma curve to the video signal.

According to the third embodiment, no gamma curves other than the elements with the set values of −4, −2, 0, and +4 are not particularly illustrated. A gamma curve with a set value of +2 has intermediate characteristics between the gamma curves of +4 and 0. A gamma curve with a set value of +3 has intermediate characteristics between the gamma curves of +4 and +2. A gamma curve with a set value of +1 has intermediate characteristics between the gamma curves of +2 and 0. A gamma curve with a set value of −1 has intermediate characteristics between the gamma curves of 0 and −2. A gamma curve with a set value of −3 has intermediate characteristics between the gamma curves of −2 and. −4.

According to the third embodiment, the unmodified gamma curves illustrated in FIGS. 9 and 10 have a gamma coefficient of 2.2. The third embodiment is not limited a gamma coefficient of 2.2. The gamma controller 12 may employ a gamma coefficient different from 2.2 for the unmodified gamma curve.

The gamma controller 12 may employ mutually different gamma coefficients as gamma coefficients of the unmodified gamma curves responsive to the set values. In other words, the gamma controller 12 may be configured to change gamma coefficients in accordance with changing the set values.

As described above, the luminance value is lowered from 900 cd/m$^2$ to 250 cd/m$^2$. The third embodiment is not limited to this setting. The setting in which the luminance value is lowered from 900 cd/m$^2$ to 700 cd/m$^2$ may also applicable to the third. embodiment and other embodiments.

Fourth Embodiment

Fourth embodiment of the disclosure is described below. For convenience of explanation, elements identical to the elements is the embodiments described above are designated with the same reference numerals and the discussion thereof is not repeated herein.

Figure 11:
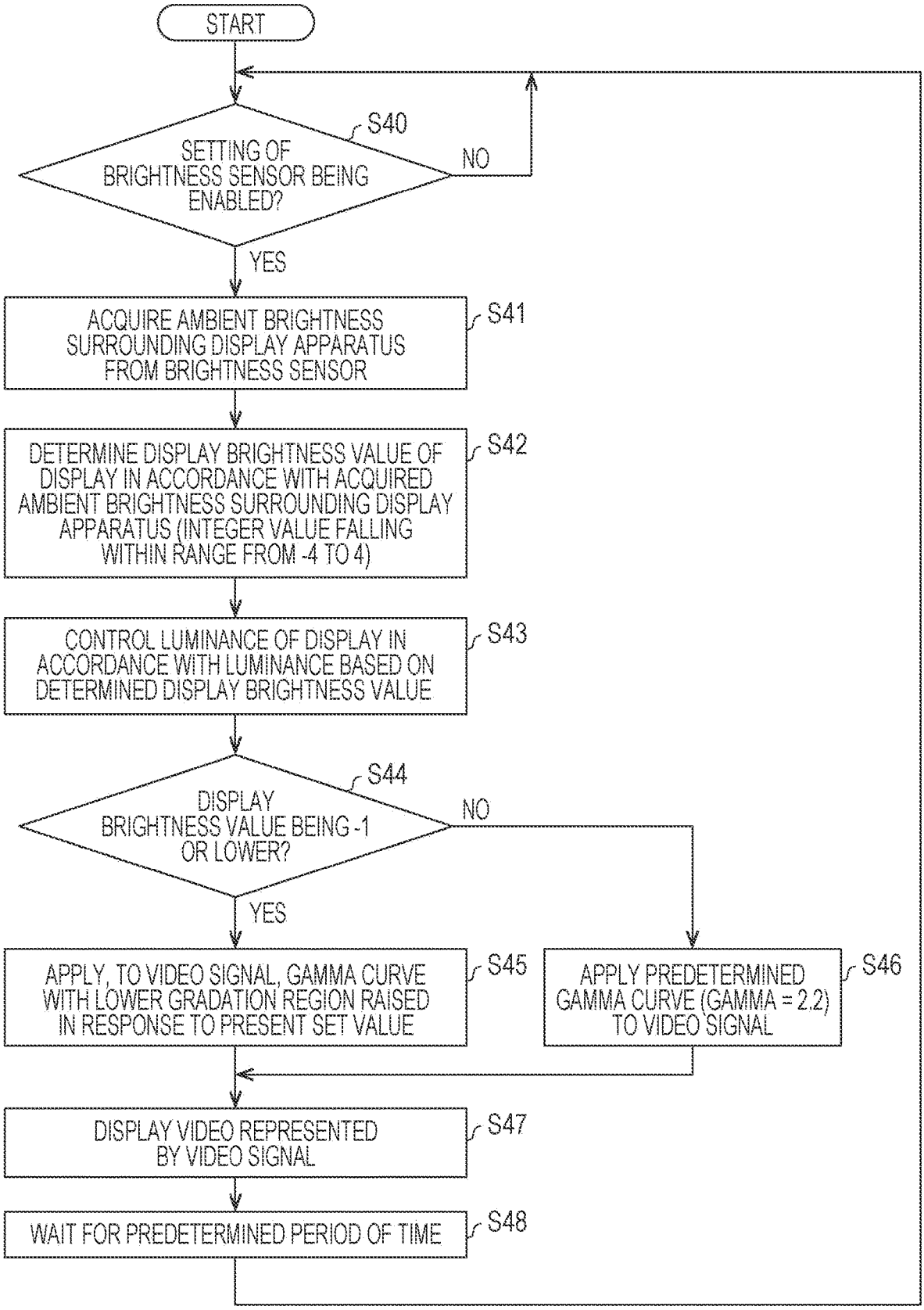
FIG. 11 is a flowchart illustrating a display method of the display apparatus of a fourth embodiment of the disclosure.

The fourth embodiment is described with reference to FIGS. 11 through 13. FIG. 11 is a flowchart illustrating a display method of the display apparatus 1 in accordance with the fourth embodiment. According to the fourth embodiment, an optical picture control (OPC) function of a brightness sensor in the display apparatus 1 detects darkness surrounding the display apparatus 1 and the luminance of the display apparatus 1 is lowered.

Referring to FIG. 11, the display controller determines in step S40 whether the setting of the brightness sensor is enabled. If the display controller determines that the setting of the brightness sensor is enabled (yes path in step S40), processing proceeds to step S41. On the other hand, if the display controller determines that the setting of the brightness sensor is not enabled (no path in step S40), the operation in step S40 is repeated.

In step S41, the display controller acquires, from the brightness sensor, ambient brightness surrounding the display apparatus 1. In step S42, the display controller determines the value of display brightness in accordance with the ambient brightness of the display apparatus 1 acquired by the brightness sensor. The display brightness value may be an integer falling within a range of −4 or higher to +4 or lower. The determination method is described below.

In step S43, the luminance controller 11 controls the luminance of the display 14 to luminance that is based on the display brightness value determined by the display controller.

In step S44, the display controller determines whether the display brightness value is equal to or below −1. If the display controller determines that the display brightness value is equal to or lower than −1 (yes path in step S44), processing proceeds to step S45. If the display controller determines that the display brightness value is higher than −1 (no path in step S44), processing proceeds to step S46.

In step S45, the gamma controller 12 applies to the video signal the gamma curve with the lower gradation region raised in response to the present setting results and processing proceeds to step S47. In step S46, the gamma controller 12 applies to the video signal a predetermined gamma curve of, for example, a gamma of 2.2 and processing proceeds to step S47. In step S47, the display 14 displays a video represented by the video signal. In step S48, the display apparatus 1 is caused to wait for a predetermined period of time. When the predetermined period of time has elapsed, processing returns to step S40.

Figure 12:
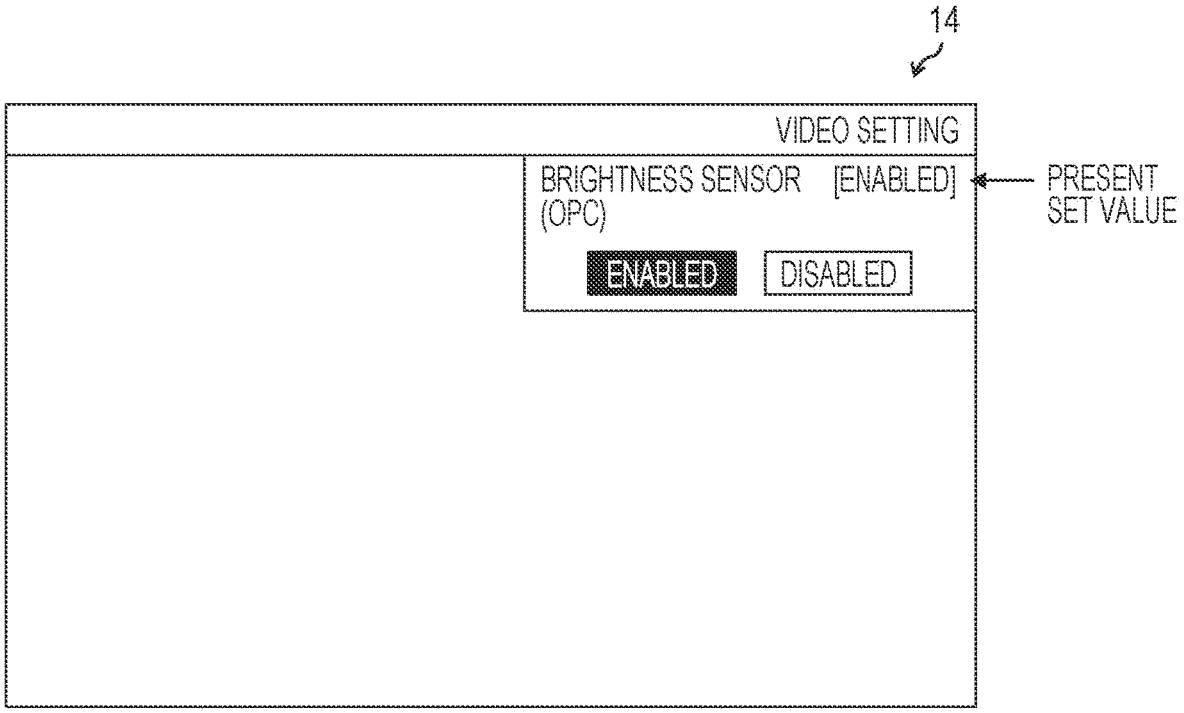
FIG. 12 illustrates a display example of the display method illustrated in FIG. 11.
Figure 13:
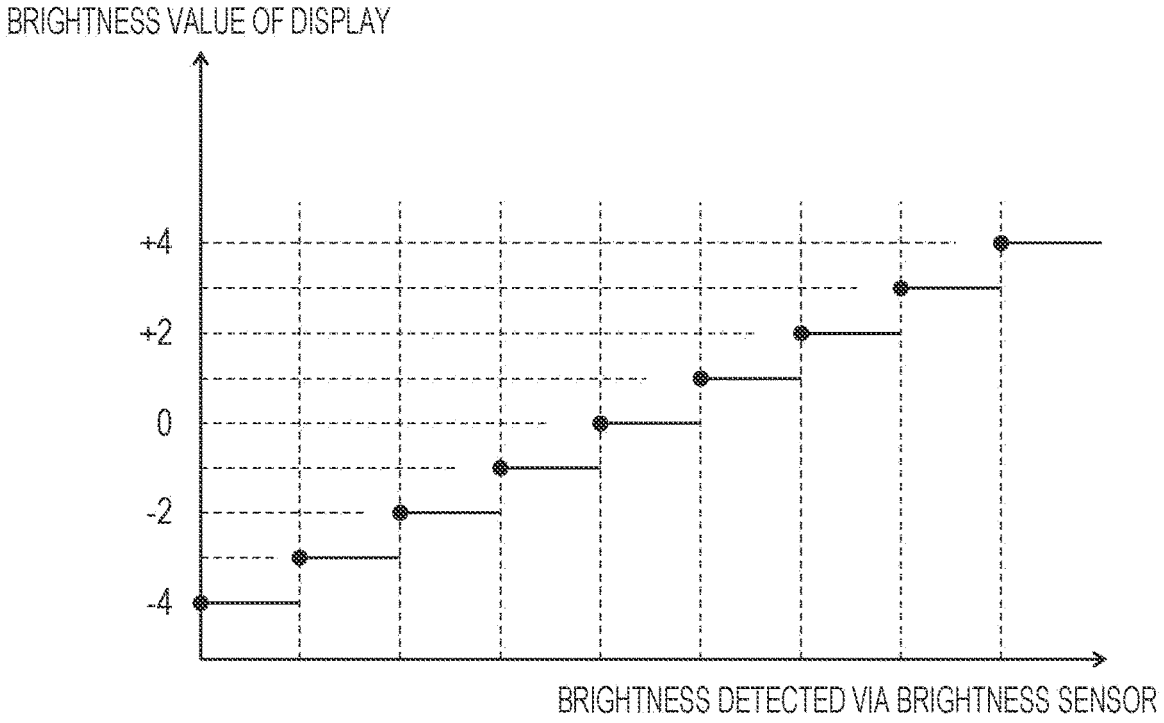
FIG. 13 is a graph illustrating correspondence information that is referenced by a display controller in the display method illustrated in FIG. 11.

FIG. 12 illustrates a display example of the display method illustrated in FIG. 11. Referring to FIG. 12, for example, a video setting item is displayed on a display screen of the display 14. For example, the viewer may set the brightness sensor function to be on (enabled) or off (disabled) by setting the setting item of a menu, for example, the setting of the brightness sensor. Referring to FIG. 12, the present set value (setting status) is enabled.

The fourth embodiment is described with reference to FIG. 13. FIG. 13 is a graph illustrating correspondence information that is referenced by the display controller in the display method illustrated in FIG. 11. The correspondence information indicates correspondence between the brightness detected by the brightness sensor and the display brightness. In the determination operation in step S42 in FIG. 11, using the graph in FIG. 13, the display controller determines the display brightness value in response to the ambient brightness of the display apparatus 1 acquired by the brightness sensor. Referring to FIG. 13, the abscissa represents the brightness detected by the brightness sensor and the ordinate represents the display brightness value of the display apparatus 1.

Fifth Embodiment

Fifth embodiment is described below. For convenience of explanation, elements identical to the elements described with reference to the embodiments described above are designated with the same reference numerals and the discussion thereof is not repeated herein.

Figure 14:
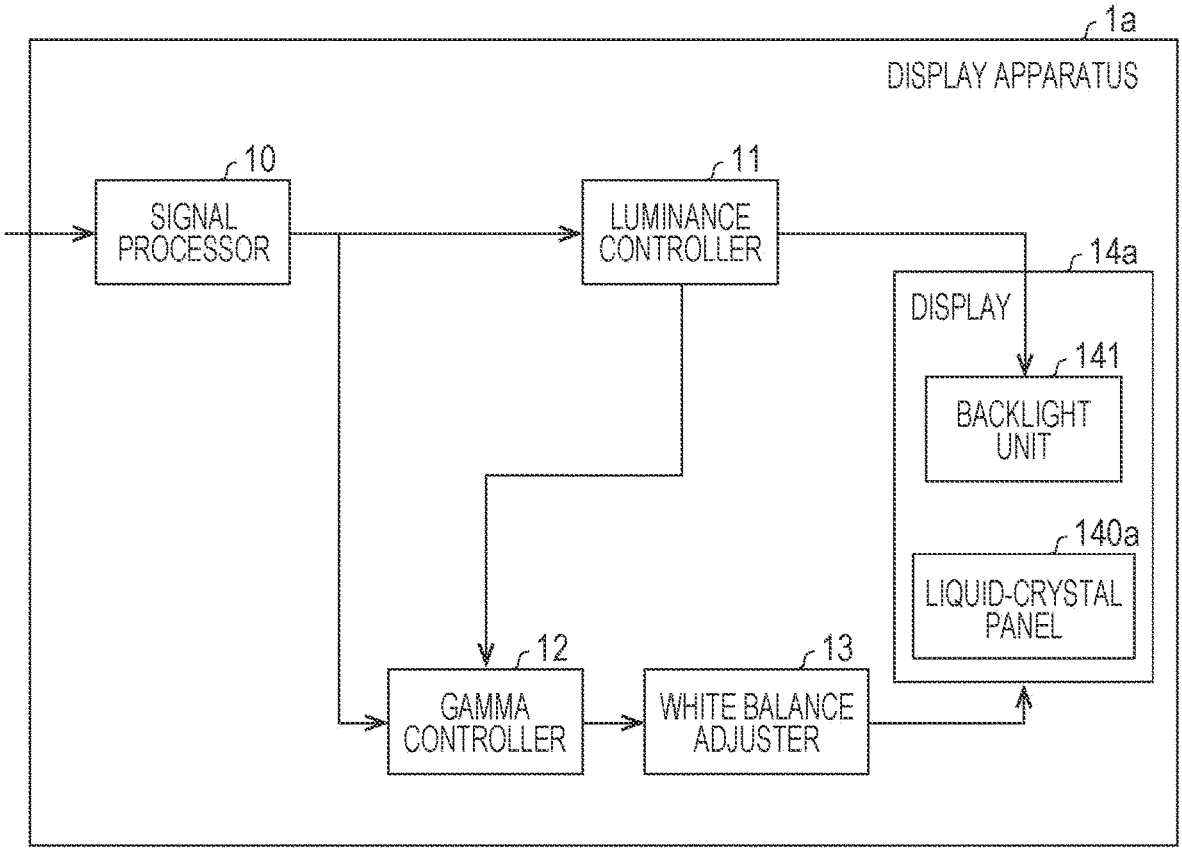
FIG. 14 is a block diagram illustrating a configuration of a display apparatus of a fifth embodiment of the disclosure.

The fifth embodiment is described with reference to FIG. 14. FIG. 14 is a block diagram illustrating a configuration of a display apparatus 1*a* of the fifth embodiment. In comparison with each of the above-described embodiments, a display 14*a* of the fifth embodiment is different. The following discussion focuses on the difference.

Referring to FIG. 14, the display 14*a* in the display apparatus 1*a* includes the liquid-crystal panel 140*a* and backlight unit 141. In the embodiments of the disclosure, the display 14 may include the liquid-crystal panel 140*a* instead of the organic EL panel 140. The configuration with the liquid-crystal panel 140*a* may perform the process of each of the embodiments.

Sixth Embodiment

Sixth embodiment is described below. For convenience of explanation, elements identical to the elements described with reference to the embodiments described above are designated with the same reference numerals and the discussion thereof is not repeated herein.

Figure 15:
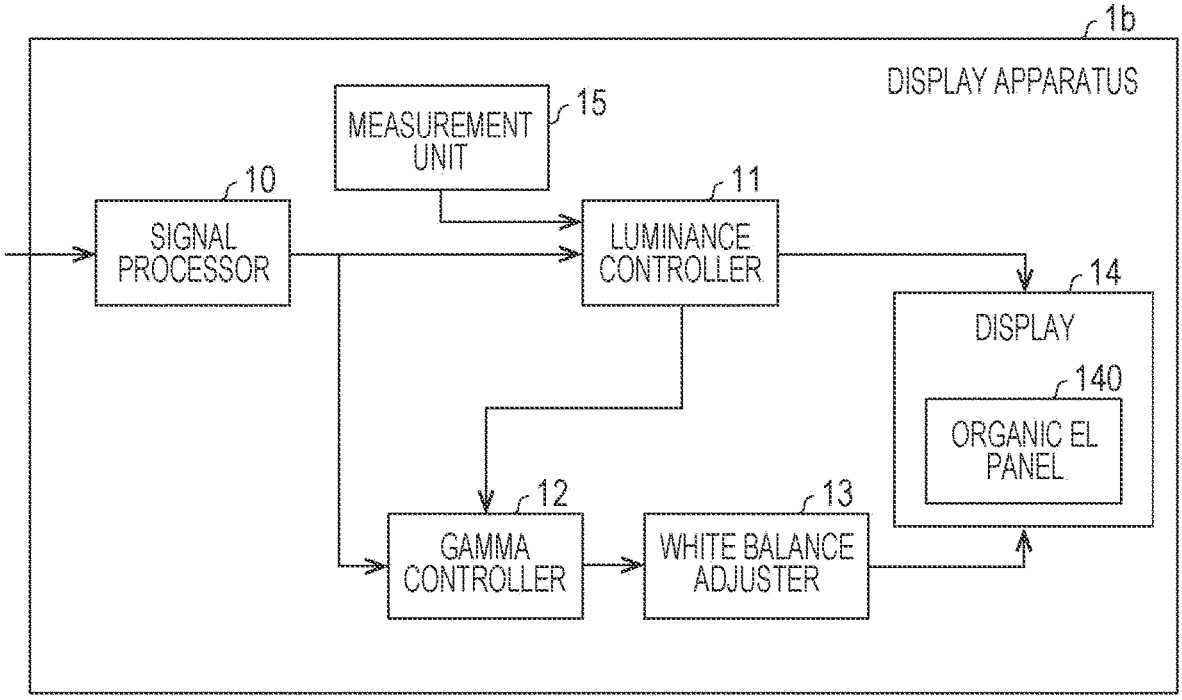
FIG. 15 is a block diagram illustrating a configuration of a display apparatus of a sixth embodiment of the disclosure.

FIG. 15 is a block diagram illustrating a configuration of a display apparatus 1*b* of the sixth embodiment of the disclosure. In comparison with the first embodiment, the difference is that the display apparatus 1*b* of the sixth embodiment further includes a measurement unit 15. The following discussion focuses on the difference.

Referring to 15, the measurement unit 15 in the display apparatus 1*b* includes, for example, a timer and a human detection sensor.

According to the sixth embodiment, in response to when a predetermined condition is satisfied, the luminance controller 11 may cause the display 14 to display the video at a luminance value of, for example, 250 cd/m$^2$ lower than a predetermined luminance value of 500 cd/m$^2$.

The predetermined. condition may be satisfied when the viewer of the display apparatus 1*b* has left his or her seat for a constant period of time. Specifically, if the measurement unit 15 in the display apparatus 1*b* detects a constant period of time elapse from the moment the viewer has left the seat or is unable to detect the viewer with the detection sensor, the luminance controller 11 may lower the luminance value of the display 14.

The six embodiment may provide the same effect as the first embodiment and lead to a reduction in the power consumption of the display apparatus 1*b*.

Seventh Embodiment

Seventh embodiment is described below. For convenience of explanation, elements identical to the elements described with reference to the embodiments described above are designated with the same reference numerals and the discussion thereof is not repeated herein.

Figure 16:
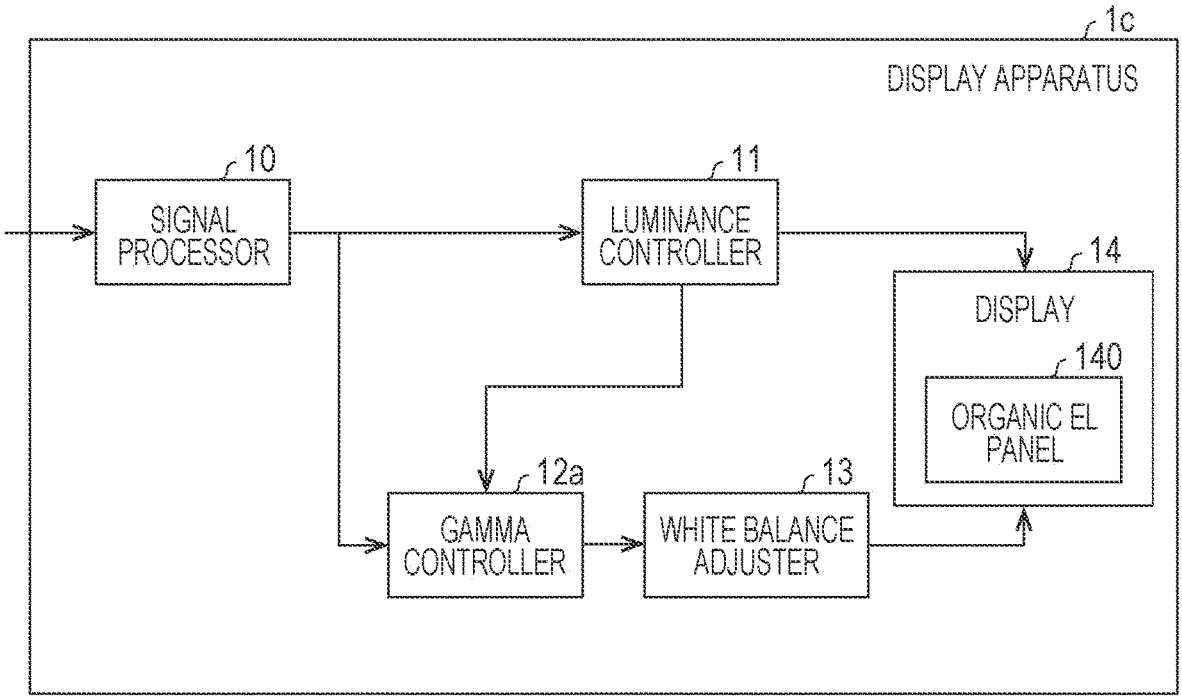
FIG. 16 is a block diagram illustrating a configuration of a display apparatus of a seventh embodiment of the disclosure.

The seventh embodiment is described with reference to FIGS. 16 through 20. FIG. 16 is a block diagram illustrating a configuration of a display apparatus is of the seventh embodiment. The seventh embodiment is different from the first embodiment in that a gamma. controller 12*a* in the display apparatus 1*c* of the seventh embodiment is different in terms of control content. The following discussion. focuses on the difference.

Referring to FIG. 16, the display apparatus 1*c* includes the luminance controller 11, gamma controller 12*a*, and display 14. When the luminance controller 11 causes the display 14 to display the video at a luminance value lower than a predetermined luminance value, the gamma controller 12*a* applies to the video signal a gamma curve having a gamma coefficient smaller than a gamma coefficient of a gamma curve that is applied when the video is displayed at the predetermined luminance value or higher.

Figure 17:
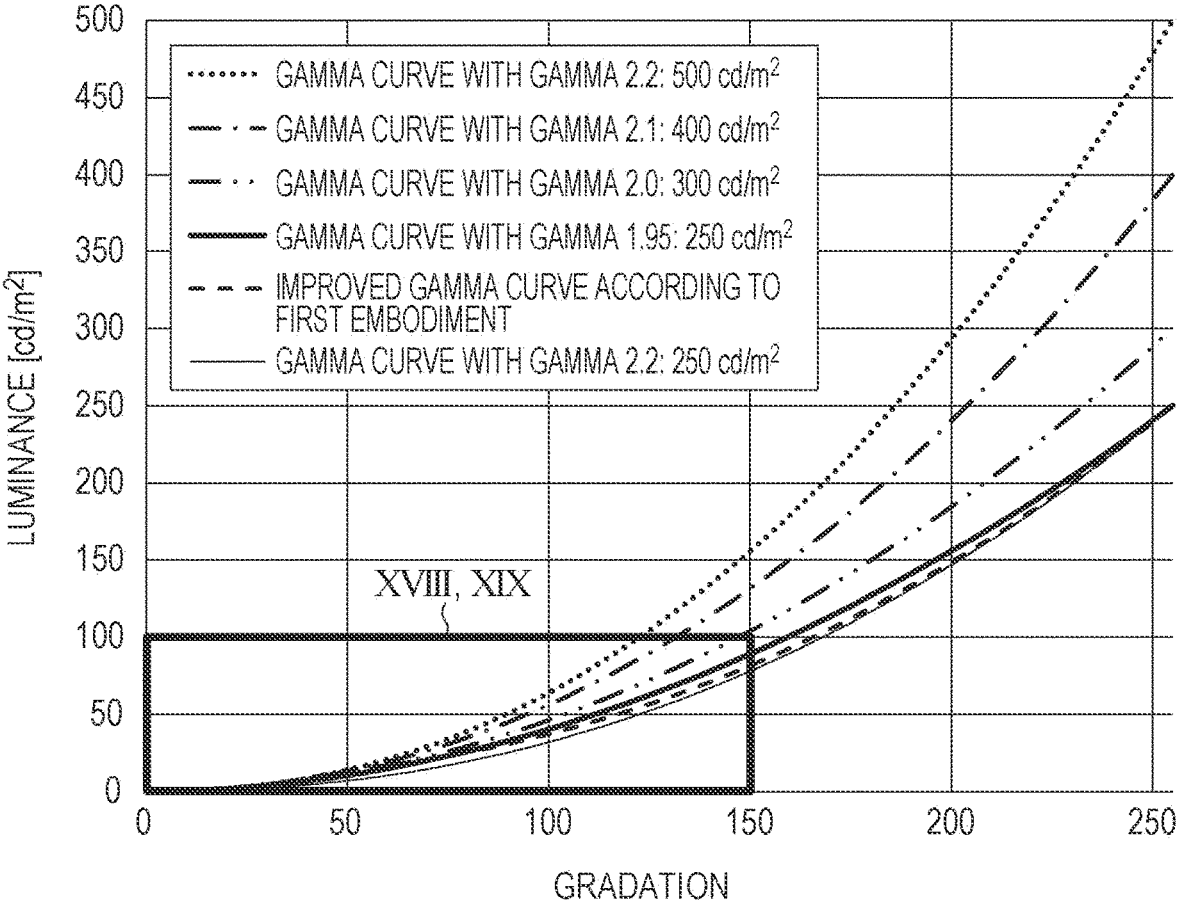
FIG. 17 is a graph illustrating results of control performed by the gamma controller illustrated in FIG. 16.
Figure 18:
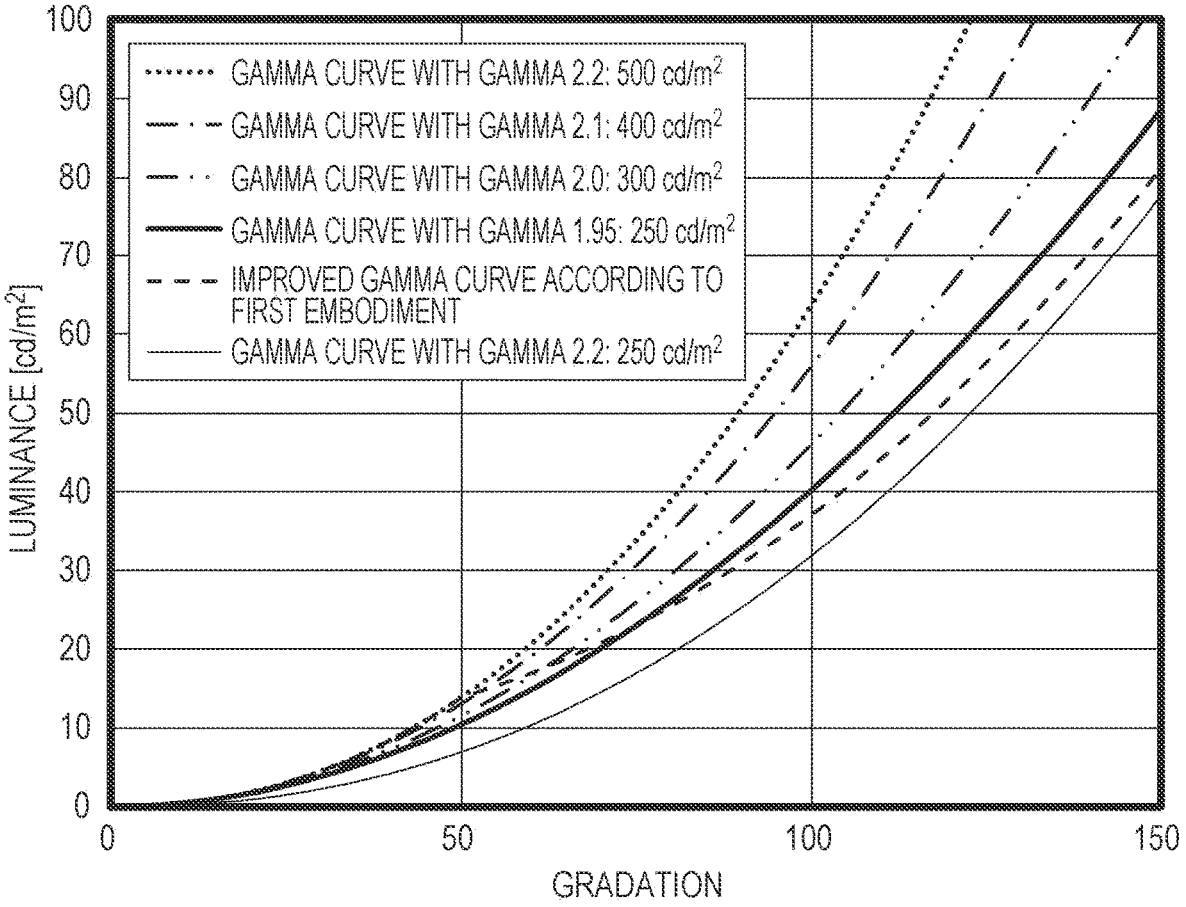
FIG. 18 is an expanded view of the portion XVIII of FIG. 17.
Figure 19:
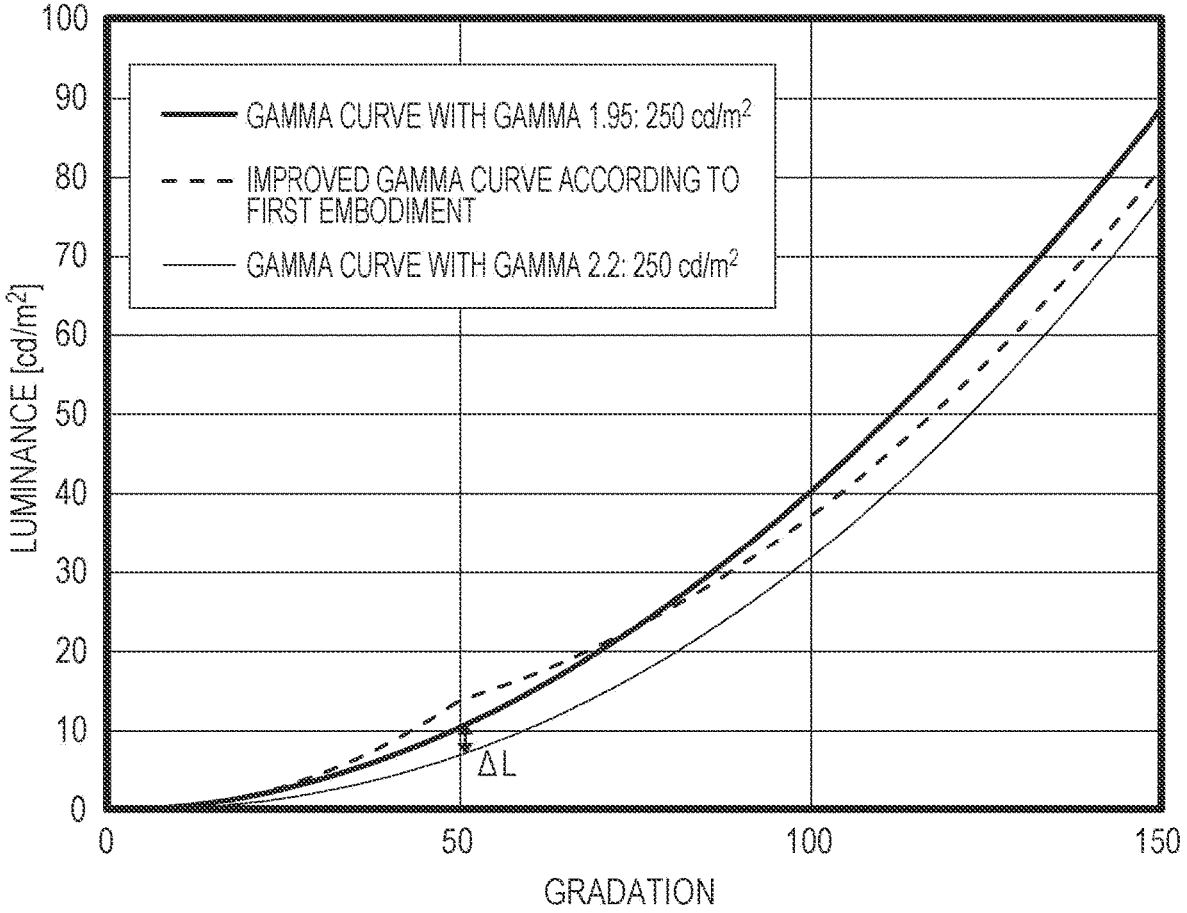
FIG. 19 illustrates part of the portion XIV of FIG. 17.

FIG. 17 illustrates a graph illustrating results of control performed by the gamma controller 12*a* illustrated in FIG. 16. FIG. 18 is an expanded view of the portion XVIII of FIG. 17. FIG. 19 illustrates part of the portion XIX of FIG. 17. Referring to FIGS. 17 through 19, for example, if the luminance controller 11 lowers the luminance value from 500 cd/m$^2$ serving as the predetermined luminance value to 250 cd/m$^2$, the gamma controller 12*a* applies to the video signal the gamma curve having one of gamma coefficients of 2.1, 2.0, and 1.95 that is lower than a gamma coefficient of 2.2 as the gamma coefficient of the gamma curve applied when the video is displayed at the predetermined luminance value of 500 cd/m$^2$ or higher.

Referring to FIGS. 17 and 18, the abscissa represents the gradation and the ordinate represents the luminance. As illustrated in FIGS. 17 and 18, dotted-line curves are gamma curves expressed by a gamma coefficient of 2.2 set for 500 cd/m$^2$, dot-dash-line curves are gamma curves expressed by a gamma coefficient of 2.1 set for 400 cd/m$^2$, two-dot-chain-line curves are gamma curves expressed by a gamma coefficient of 2.0 set for 300 cd/m$^2$, solid-line curves are gamma curves expressed by a gamma coefficient of 1.95 set for 250 cd/m$^2$, broken-line curves are gamma curves modified in accordance with the first embodiment, and thin-line curves are gamma curves expressed by a gamma coefficient of 2.2 set for 250 cd/m$^2$.

According to the seventh embodiment, referring to FIG. 19, with respect to the broken-line gamma curve and thin-line gamma curve, the gamma controller 12*a* applies to the video signal the solid-line gamma curve having a gamma of 1.95 with the luminance value lowered to 250 cd/m$^2$.

A gamma of 1.95 is a gamma coefficient smaller than a gamma of 2.2 as the gamma coefficient of the gamma curve that is applied when the video is displayed at a luminance value equal to or above the predetermined luminance value.

ΔL in FIG. 19 indicates a luminance difference between the gamma curve having a gamma of 1.95 and the gamma curve having a gamma of 2.2 of at the gradation value of 50 in the 8-bit gradation.

In the configuration. described above, if the luminance value is lowered, as operation of causing gradations of a darker image in a lower gradation region to be more recognizable may be more easily performed.

Figure 20:
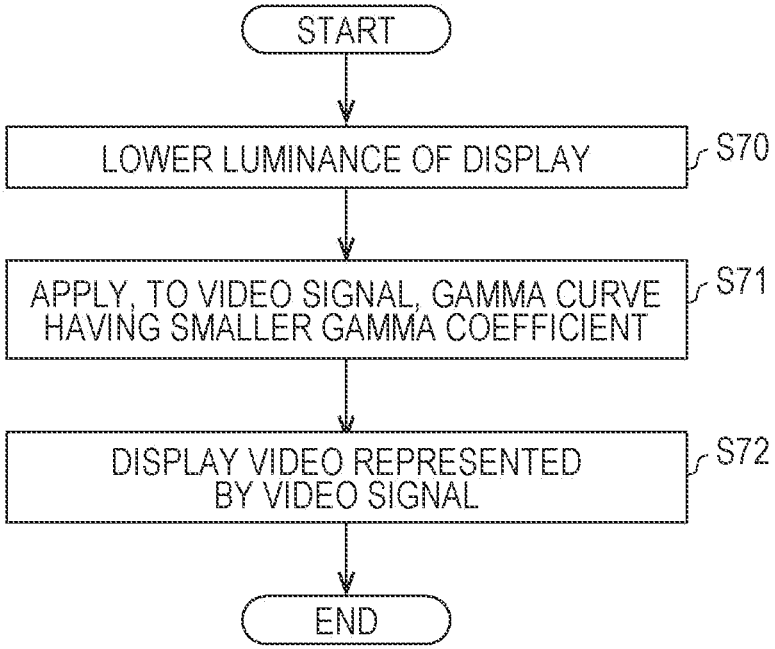
FIG. 20 is a flowchart illustrating a display method of the display apparatus illustrated in FIG. 16.

The display method of the seventh embodiment is described with reference to FIG. 20. FIG. 20 is a flowchart illustrating the display method performed by the display apparatus 1*c* illustrated in FIG. 16. Referring to FIG. 20, a luminance control operation in step S70 performs control such that the luminance of a displayed video on the display is lowered.

In step S71, when the video is displayed in a display operation at a luminance value that is set to be lower than the predetermined luminance value in the luminance control operation, the display controller performs a gamma control operation to apply to the video signal the gamma curve having a gamma coefficient smaller than the gamma coefficient of the gamma curve applied when the video is displayed at the predetermined luminance value or higher.

In step S72, the display operation displays the video represented by the video signal to which the gamma curve obtained in the gamma control operation is applied.

As described above, the gamma coefficients are switched. According to the seventh embodiment, however, tables of gamma coefficients may be formed and the gamma curve may be switched by switching the tables from one to another.

Conclusions

The display apparatus (1 or 1*a*) of a first aspect of the disclosure includes the display controller including the luminance controller (11) that controls a luminance of a displayed video and the gamma controller (12) that adjusts a gain of a video signal; and the display (14) that displays a video represented by a video signal that has been adjusted by the gamma controller, wherein if the luminance controller causes the display to display the video at a luminance value lower than a predetermined luminance value, the display controller: compares a first luminance and a second luminance respectively in a first gradation and a second gradation or the video that is brighter than the first gradation with a third luminance and a fourth luminance respectively in the first gradation and the second gradation of the video when the luminance controller causes the display to display the video at the predetermined luminance value; and controls luminance of the display such that a second amount of change with the fourth luminance serving as a denominator and the second luminance serving as a numerator is lower than a first amount of change with the third luminance serving as a denominator and the first luminance serving as a numerator.

According to the first aspect, the gradations of a darker image in a lower gradation region may be easier to recognize even when the luminance value is lowered to control burning.

The display apparatus (1 or 1*a*) of a second aspect of the disclosure includes the luminance controller (11) that controls a luminance of a displayed video; the gamma controller (12) that applies a gamma curve to a video signal; and the display (14) that displays a video represented by the video signal that the gamma controller has applied the gamma curve to, wherein if the luminance controller causes the display to display the video at a luminance value lower than a predetermined luminance value, the gamma controller applies to the video signal a gamma curve having a lower gradation region raised more than a gamma curve represented by a predetermined constant gamma coefficient.

According to the second aspect, the gradations of a darker image in a lower gradation region may be easier to recognize even when the luminance value is lowered to control burning.

In the display apparatus (1 or 1*a*) according to a third aspect of the disclosure in view of the second aspect, the gamma curve applied by the gamma controller may be, in a gradation region at a predetermined gradation value or lower, superimposed on a gamma curve represented by a constant gamma coefficient and responding to a predetermined output luminance, and may be, in a gradation region higher than the predetermined gradation value, closer to the gamma curve represented by the constant gamma coefficient and responding to an output luminance lower than the predetermined output luminance.

According to the third aspect, the gradations of a darker image in a lower gradation region may be easier to recognize eve. when the luminance value is lowered to control burning.

In the display apparatus (1 or 1*a*) of a fourth aspect of the disclosure in view of the third aspect, the predetermined gradation value may be within a range of 5% or higher to 25% or lower than a maximum design value of gradation value.

According to the fourth aspect, a predetermined gradation value may be appropriately set.

The display apparatus (1*b*) of a fifth aspect of the disclosure includes the luminance controller (11) that controls luminance of a displayed video; the gamma controller (12*a*) that applies a gamma curve to a video signal; and the display (14) that displays a video represented by the video signal that the gamma controller has applied the gamma curve to, wherein if the luminance controller causes the display to display the video at a luminance value lower than a predetermined luminance value, the gamma controller applies to the video signal a gamma curve having a gamma coefficient lower than a gamma coefficient of the gamma curve that is applied to display the video at the predetermined luminance value or higher.

The fifth aspect may provide the same effect as the second aspect.

In the display apparatus (1, 1*a*, or 1*b*) of a sixth aspect of the disclosure in view of one of the second through fifth aspects, the display may include an organic electroluminescent panel.

In the display apparatus (1*a*) of a seventh aspect of the disclosure in view of one of the second through sixth aspects, the luminance controller may cause the display to display the video at the luminance value lower than the predetermined luminance value in response to when a predetermined condition is satisfied.

The seventh aspect may provide the same effect as the second aspect and may provide a lower-power consumption feature to the display apparatus 1*a*.

The display method of a display apparatus according to an eighth aspect of the disclosure includes controlling a luminance of a video and adjusting a gain of a video signal; and displaying a video represented by the video signal that has been adjusted in the adjusting of the gain, wherein if the video is displayed in the displaying of the video at a luminance value lower than a predetermined luminance value, a first luminance and a second luminance respectively in a first gradation and a second gradation of the video that is brighter than the first gradation are compared with a third luminance and a fourth luminance respectively in the first gradation and the second gradation of the video with the video displayed at the predetermined luminance value in the displaying of the video; and luminance is controlled such that a second amount of change with the fourth luminance serving as a denominator and the second luminance serving as a numerator is lower than a first amount of change with the third luminance serving as a denominator and the first luminance serving as a numerator.

The display method of a display apparatus according a ninth aspect of the disclosure includes controlling a luminance of a displayed video; applying a gamma curve to a video signal; and displaying a video represented by the video signal that the gamma curve has been applied to is the applying of the gamma curve, wherein if the video is displayed in the displaying of the video at a luminance value that is lower than a predetermined luminance value is the controlling of the luminance, a gamma curve having a lower gradation region raised more than a gamma curve represented by a constant gamma coefficient is applied to the video signal is the applying of the gamma curve.

The ninth aspect may provide the same effect as the second aspect.

The display method of a display apparatus according a tenth aspect of the disclosure includes controlling a luminance of a displayed video; applying a gamma curve to a video signal; and displaying a video represented by the video signal that the gamma curve has been applied to in the applying of the gamma curve, wherein if the video is displayed in the displaying of the video at a. luminance value that is lower than a predetermined luminance value in the controlling of the luminance, a gamma curve having gamma coefficient lower than a gamma coefficient of the gamma curve that is applied to display the video at the predetermined luminance value or higher is applied. to the video signal in the applying of the gamma curve.

The tenth aspect may provide the same effect as the fifth aspect.

In the display method according to an eleventh aspect of the disclosure in view of one of the ninth and tenth aspects, in response to when a predetermined condition is satisfied, the video is displayed in the displaying of the video at the luminance value that is lower than the predetermined luminance value in the controlling of the luminance.

The eleventh aspect may provide the same effect as the sixth aspect.

Each of the embodiments of the disclosure has been described with reference to the organic EL display apparatus. The disclosure may also be applicable to an liquid-crystal display apparatus.

The present disclosure contains subject matter related to that disclosed in Japanese Priority Patent Application JP 2021-119742 filed in the Japan Patent Office on Jul. 20, 2010, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A display apparatus comprising:

a display controller including:

a luminance controller that controls a displayed video according to a selected maximum luminance value; and a gamma controller that adjusts a gain of a video signal; and a display that displays a video represented by the video signal that has been adjusted by the gamma controller, wherein if the luminance controller causes the display to display the video according to a lower maximum luminance value that is lower than a higher maximum luminance value, the gamma controller compares a first luminance and a second luminance respectively in a first gradation and a second gradation of the video according to the lower maximum luminance value with a third luminance and a fourth luminance respectively in the first gradation and the second gradation of the video when the luminance controller causes the display to display the video according to the higher maximum luminance value, the first gradation being in a lower gradation region that is at a first gradation value or lower, and the second gradation being in a higher gradation region that is higher than the first gradation value, and adjusts the gain of the video signal such that:

a second amount of change, with the fourth luminance serving as a denominator of the second amount of change and the second luminance serving as a numerator of the second amount of change, is lower than a first amount of change, with the third luminance serving as a denominator of the first amount of change and the first luminance serving as a numerator of the first amount of change, wherein the luminance controller causes the display to display the video according to the lower maximum luminance value if a state of an amount of change of an image in an adjacent frame that is less than a threshold value has continued for a threshold period of time.

2. The display apparatus according to claim 1, wherein if the luminance controller causes the display to display the video according to the lower maximum luminance value, the gamma controller applies to the video signal a modified gamma curve in which the lower gradation region is higher than a first gamma curve represented by a first constant gamma coefficient and corresponding to the lower maximum luminance value.

3. The display apparatus according to claim 2, wherein the modified gamma curve applied by the gamma controller is in the lower gradation region, a second gamma curve represented by the first constant gamma coefficient and corresponding to the higher maximum luminance value, and in the higher gradation region, between the first gamma curve and the second gamma curve.

4. The display apparatus according to claim 3, wherein the first gradation value is within a range of 5% or higher to 25% or lower than a maximum design value of gradation value.

5. A display apparatus comprising:

a display controller including:

a luminance controller that controls a displayed video according to a selected maximum luminance value; and a gamma controller that adjusts a gain of a video signal; and a display that displays a video represented by the video signal that has been adjusted by the gamma controller, wherein if the luminance controller causes the display to display the video according to a lower maximum luminance value that is lower than a higher maximum luminance value, the gamma controller compares a first luminance and a second luminance respectively in a first gradation and a second gradation of the video according to the lower maximum luminance value with a third luminance and a fourth luminance respectively in the first gradation and the second gradation of the video when the luminance controller causes the display to display the video according to the higher maximum luminance value, the first gradation being in a lower gradation region that is at a first gradation value or lower, and the second gradation being in a higher gradation region that is higher than the first gradation value, and adjusts the gain of the video signal such that:

a second amount of change, with the fourth luminance serving as a denominator of the second amount of change and the second luminance serving as a numerator of the second amount of change, is lower than a first amount of change, with the third luminance serving as a denominator of the first amount of change and the first luminance serving as a numerator of the first amount of change, wherein the luminance controller causes the display to display the video according to the lower maximum luminance value if a temperature of a display panel module is higher than a threshold temperature.

6. The display apparatus according to claim 5, wherein if the luminance controller causes the display to display the video according to the lower maximum luminance value that is lower than the higher maximum luminance value, the gamma controller applies to the video signal a modified gamma curve in which the lower gradation region is higher than a first gamma curve represented by a first constant gamma coefficient and corresponding to the lower maximum luminance value.

7. The display apparatus according to claim 6, wherein the modified gamma curve applied by the gamma controller is in the lower gradation region, a second gamma curve represented by the first constant gamma coefficient and corresponding to the higher maximum luminance value, and in the higher gradation region, between the first gamma curve and the second gamma curve.

8. The display apparatus according to claim 7, wherein the first gradation value is within a range of 5% or higher to 25% or lower than a maximum design value of gradation value.

9. A display apparatus comprising:

a display controller including:

a luminance controller that controls a displayed video according to a selected maximum luminance value; and a gamma controller that adjusts a gain of a video signal; and a display that displays a video represented by the video signal that has been adjusted by the gamma controller, wherein if the luminance controller causes the display to display the video according to a lower maximum luminance value that is lower than a higher maximum luminance value, the gamma controller compares a first luminance and a second luminance respectively in a first gradation and a second gradation of the video according to the lower maximum luminance value with a third luminance and a fourth luminance respectively in the first gradation and the second gradation of the video when the luminance controller causes the display to display the video according to the higher maximum luminance value, the first gradation being in a lower gradation region that is at a first gradation value or lower, and the second gradation being in a higher gradation region that is higher than the first gradation value, and adjusts the gain of the video signal such that:

a second amount of change, with the fourth luminance serving as a denominator of the second amount of change and the second luminance serving as a numerator of the second amount of change, is lower than a first amount of change, with the third luminance serving as a denominator of the first amount of change and the first luminance serving as a numerator of the first amount of change, wherein the luminance controller causes the display to display the video according to the lower maximum luminance value if an optical picture control function of a brightness sensor in the display apparatus detects darkness surrounding the display apparatus.

10. The display apparatus according to claim 9, wherein if the luminance controller causes the display to display the video according to the lower maximum luminance value, the gamma controller applies to the video signal a modified gamma curve in which the lower gradation region is higher than a first gamma curve represented by a first constant gamma coefficient and corresponding to the lower maximum luminance value.

11. The display apparatus according to claim 10, wherein the modified gamma curve applied by the gamma controller is in the lower gradation region, a second gamma curve represented by the first constant gamma coefficient and corresponding to the higher maximum luminance value, and in the higher gradation region, between the first gamma curve and the second gamma curve.

12. The display apparatus according to claim 11, wherein the first gradation value is within a range of 5% or higher to 25% or lower than a maximum design value of gradation value.

13. A display apparatus comprising:

a display controller including:

a luminance controller that controls a displayed video according to a selected maximum luminance value; and a gamma controller that adjusts a gain of a video signal; and a display that displays a video represented by the video signal that has been adjusted by the gamma controller, wherein if the luminance controller causes the display to display the video according to a lower maximum luminance value that is lower than a higher maximum luminance value, the gamma controller compares a first luminance and a second luminance respectively in a first gradation and a second gradation of the video according to the lower maximum luminance value with a third luminance and a fourth luminance respectively in the first gradation and the second gradation of the video when the luminance controller causes the display to display the video according to the higher maximum luminance value, the first gradation being in a lower gradation region that is at a first gradation value or lower, and the second gradation being in a higher gradation region that is higher than the first gradation value, and adjusts the gain of the video signal such that:

a second amount of change, with the fourth luminance serving as a denominator of the second amount of change and the second luminance serving as a numerator of the second amount of change, is lower than a first amount of change, with the third luminance serving as a denominator of the first amount of change and the first luminance serving as a numerator of the first amount of change, wherein the luminance controller causes the display to display according to the lower maximum luminance value by an operation with respect to a setting item in a menu.

14. The display apparatus according to claim 13, wherein if the luminance controller causes the display to display the video according to the lower maximum luminance value, the gamma controller applies to the video signal a modified gamma curve in which the lower gradation region is higher than a first gamma curve represented by a first constant gamma coefficient and corresponding to the lower maximum luminance value.

15. The display apparatus according to claim 14, wherein the modified gamma curve applied by the gamma controller is in the lower gradation region, a second gamma curve represented by the first constant gamma coefficient and corresponding to the higher maximum luminance value, and in the higher gradation region, between the first gamma curve and the second gamma curve.

16. The display apparatus according to claim 15, wherein the first gradation value is within a range of 5% or higher to 25% or lower than a maximum design value of gradation value.

* * * * *